US010824101B2

(12) United States Patent
Furuichi et al.

(10) Patent No.: US 10,824,101 B2
(45) Date of Patent: Nov. 3, 2020

(54) HEATING DEVICE, FIXING DEVICE, AND IMAGE FORMING APPARATUS

(71) Applicants: Yuusuke Furuichi, Kanagawa (JP); Tomoya Adachi, Kanagawa (JP); Yukimichi Someya, Saitama (JP)

(72) Inventors: Yuusuke Furuichi, Kanagawa (JP); Tomoya Adachi, Kanagawa (JP); Yukimichi Someya, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/285,733

(22) Filed: Feb. 26, 2019

(65) Prior Publication Data

US 2019/0286028 A1 Sep. 19, 2019

(30) Foreign Application Priority Data

Mar. 19, 2018 (JP) ..... 2018-050384
Feb. 5, 2019 (JP) ..... 2019-018754

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2053; G03G 2215/2035
See application file for complete search history.

(56) References Cited

U.S. PATENT DOCUMENTS 6,455,811 B2 * 9/2002 Otsuka ..... G03G 15/2053 118/60
2014/0161479 A1 * 6/2014 Yoshida ..... G03G 15/2053 399/90

FOREIGN PATENT DOCUMENTS

JP 2002-117959 4/2002

* cited by examiner

*Primary Examiner* — Clayton E. LaBalle
*Assistant Examiner* — Michael A Harrison
(74) *Attorney, Agent, or Firm* — Harness, Dickey and Pierce, P.L.C.

(57) ABSTRACT

A heating device includes a heater that heats an object to be heated. A holder supports the heater and includes an engaged portion. The heater includes a contact face that contacts the object to be heated. The heater further includes a separation restrictor that engages the engaged portion of the holder to restrict motion of the heater in a separating direction in which the heater separates from the holder. The separating direction is perpendicular to the contact face.

35 Claims, 25 Drawing Sheets

HEATING DEVICE, FIXING DEVICE, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2018-050384, filed on Mar. 19, 2018, and 2019-018754, filed on Feb. 5, 2019, in the Japan Patent Office, the entire disclosure of each of which is hereby incorporated by reference herein.

BACKGROUND

Technical Field

Exemplary aspects of the present disclosure relate to a heating device, a fixing device, and an image forming apparatus, and more particularly, to a heating device, a fixing device incorporating the heating device, and an image forming apparatus incorporating the fixing device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device that fixes the image on the recording medium. The fixing device employs a belt method using an endless belt.

The fixing device may include a laminated heater that heats the belt. The laminated heater is generally held by a holder and is disposed inside a loop formed by the belt. The laminated heater held by the holder may be sandwiched by a heater clip in addition to a heater connector.

However, a configuration in which the heater clip holds the laminated heater may increase the number of parts of the fixing device.

SUMMARY

This specification describes below an improved heating device. In one embodiment, the heating device includes a heater that heats an object to be heated. A holder supports the heater and includes an engaged portion. The heater includes a contact face that contacts the object to be heated. The heater further includes a separation restrictor that engages the engaged portion of the holder to restrict motion of the heater in a separating direction in which the heater separates from the holder. The separating direction is perpendicular to the contact face.

This specification further describes an improved fixing device. In one embodiment, the fixing device includes an endless belt and an opposed rotator that contacts an outer circumferential surface of the endless belt to form a fixing nip between the endless belt and the opposed rotator. The fixing device further includes the heating device described above that heats the endless belt.

This specification further describes an improved image forming apparatus. In one embodiment, the image forming apparatus includes an image forming device that forms an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
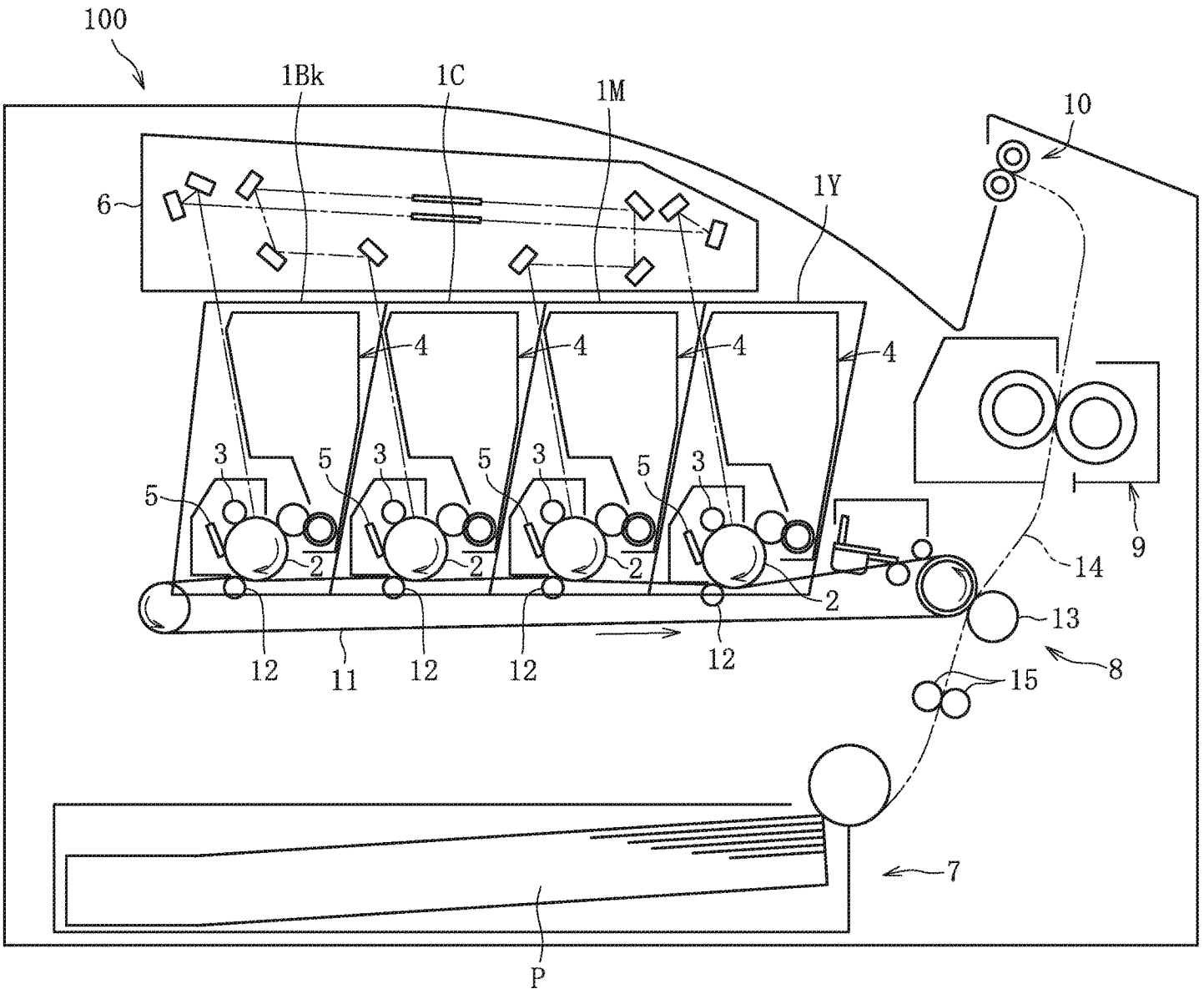
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 100 is explained.

The image forming apparatus 100 may be a copier, a facsimile machine, a printer, a multifunction peripheral or a multifunction printer (MFP) having at least two of copying, printing, scanning, facsimile, plotter, and other functions, or the like. According to this embodiment, the image forming apparatus 100 is a color printer that forms color and monochrome toner images on a recording medium by electrophotography. Alternatively, the image forming apparatus 100 may be a monochrome printer that forms a monochrome toner image on a recording medium.

Referring to the attached drawings, the following describes a construction of the image forming apparatus 100 according to embodiments of the present disclosure.

In the drawings for explaining the embodiments of the present disclosure, identical reference numerals are assigned to elements such as members and parts that have an identical function or an identical shape as long as differentiation is possible and a description of those elements is omitted once the description is provided.

FIG. 1 is a schematic cross-sectional view of the image forming apparatus 100 according to an embodiment of the present disclosure.

As illustrated in FIG. 1, the image forming apparatus 100 includes four image forming units 1Y, 1M, 1C, and 1Bk, serving as image forming devices, that are removably installed in a body of the image forming apparatus 100. The image forming units 1Y, 1M, 1C, and 1Bk have a similar construction except that the image forming units 1Y, 1M, 1C, and 1Bk contain developers in different colors, that is, yellow, magenta, cyan, and black, respectively, which correspond to color separation components for a color image. For example, each of the image forming units 1Y, 1M, 1C, and 1Bk includes a photoconductor 2, a charger 3, a developing device 4, and a cleaner 5. The photoconductor 2 is drum-shaped and serves as an image bearer. The charger 3 charges a surface of the photoconductor 2. The developing device 4 supplies toner as a developer to the surface of the photoconductor 2 to form a toner image. The cleaner 5 cleans the surface of the photoconductor 2.

The image forming apparatus 100 further includes an exposure device 6, a sheet feeding device 7, a transfer device 8, a fixing device 9, and a sheet ejection device 10. The exposure device 6 exposes the surface of each of the photoconductors 2 and forms an electrostatic latent image thereon. The sheet feeding device 7 supplies a sheet P serving as a recording medium to the transfer device 8. The transfer device 8 transfers the toner image formed on each of the photoconductors 2 onto the sheet P. The fixing device 9 fixes the toner image transferred onto the sheet P thereon. The sheet ejection device 10 ejects the sheet P onto an outside of the image forming apparatus 100.

The transfer device 8 includes an intermediate transfer belt 11, four primary transfer rollers 12, and a secondary transfer roller 13. The intermediate transfer belt 11 is an endless belt serving as an intermediate transferor stretched taut across a plurality of rollers. The four primary transfer rollers 12 serve as primary transferors that transfer yellow, magenta, cyan, and black toner images formed on the photoconductors 2 onto the intermediate transfer belt 11, respectively, thus forming a full color toner image on the intermediate transfer belt 11. The secondary transfer roller 13 serves as a secondary transferor that transfers the full color toner image formed on the intermediate transfer belt 11 onto the sheet P. The plurality of primary transfer rollers 12 is pressed against the photoconductors 2, respectively, via the intermediate transfer belt 11. Thus, the intermediate transfer belt 11 contacts each of the photoconductors 2, forming a primary transfer nip therebetween. On the other hand, the secondary transfer roller 13 is pressed against one of the rollers across which the intermediate transfer belt 11 is stretched taut via the intermediate transfer belt 11. Thus, a secondary transfer nip is formed between the secondary transfer roller 13 and the intermediate transfer belt 11.

The image forming apparatus 100 accommodates a sheet conveyance path 14 through which the sheet P fed from the sheet feeding device 7 is conveyed. A timing roller pair 15 is disposed in the sheet conveyance path 14 at a position between the sheet feeding device 7 and the secondary transfer nip defined by the secondary transfer roller 13.

Referring to FIG. 1, a description is provided of printing processes performed by the image forming apparatus 100 having the construction described above.

When the image forming apparatus 100 receives an instruction to start printing, a driver drives and rotates the photoconductor 2 clockwise in FIG. 1 in each of the image forming units 1Y, 1M, 1C, and 1Bk. The charger 3 charges the surface of the photoconductor 2 uniformly at a high electric potential. Subsequently, the exposure device 6 exposes the surface of each of the photoconductors 2 according to image data created by an original scanner that reads an image on an original or print data instructed by a terminal, thus decreasing the electric potential of an exposed portion on the photoconductor 2 and forming an electrostatic latent image on the photoconductor 2. The developing device 4 supplies toner to the electrostatic latent image formed on the photoconductor 2, forming a toner image thereon.

When the toner images formed on the photoconductors 2 reach the primary transfer nips defined by the primary transfer rollers 12 in accordance with rotation of the photoconductors 2, the toner images formed on the photoconductors 2 are transferred onto the intermediate transfer belt 11 driven and rotated counterclockwise in FIG. 1 successively such that the toner images are superimposed on the intermediate transfer belt 11, forming a full color toner image thereon. Thereafter, the full color toner image formed on the intermediate transfer belt 11 is conveyed to the secondary transfer nip defined by the secondary transfer roller 13 in accordance with rotation of the intermediate transfer belt 11 and is transferred onto a sheet P conveyed to the secondary transfer nip. The sheet P is supplied from the sheet feeding device 7. The timing roller pair 15 temporarily halts the sheet P supplied from the sheet feeding device 7. Thereafter, the sheet P is conveyed to the secondary transfer nip at a time when the full color toner image formed on the intermediate transfer belt 11 reaches the secondary transfer nip. Accordingly, the full color toner image is transferred onto and borne on the sheet P. After the toner image is transferred onto the intermediate transfer belt 11, the cleaner 5 removes residual toner remained on the photoconductor 2 therefrom.

The sheet P transferred with the full color toner image is conveyed to the fixing device 9 that fixes the full color toner image on the sheet P. Thereafter, the sheet ejection device 10 ejects the sheet P onto the outside of the image forming apparatus 100, thus finishing a series of printing processes.

A description is provided of a construction of the fixing device 9.

Figure 2:
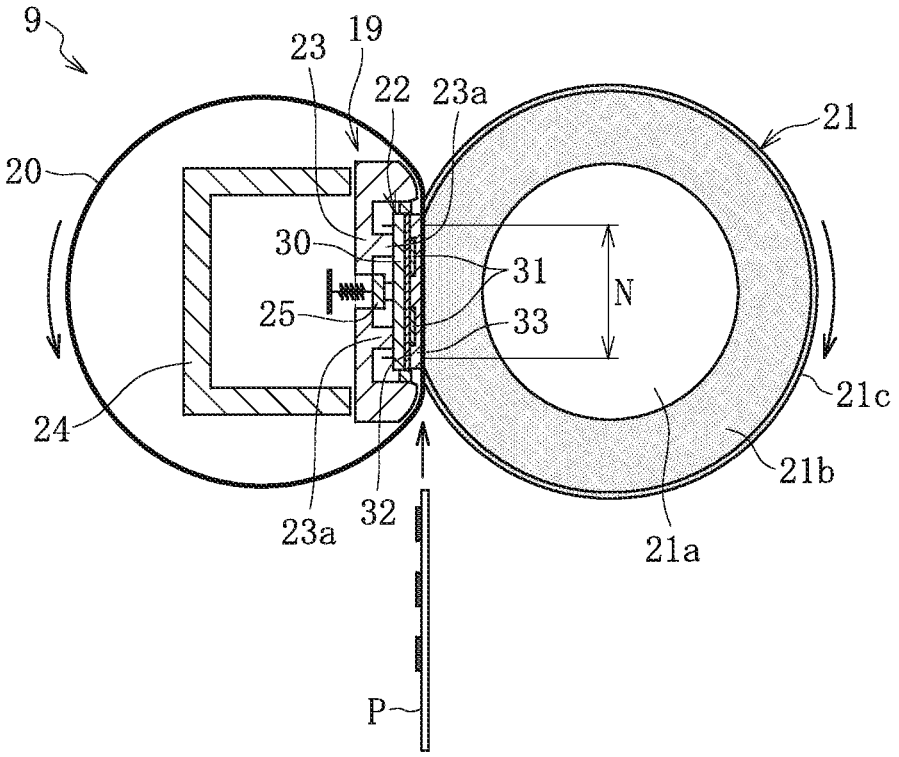
FIG. 2 is a schematic cross-sectional view of a fixing device incorporated in the image forming apparatus depicted in FIG. 1.

FIG. 2 is a schematic cross-sectional view of the fixing device 9. As illustrated in FIG. 2, the fixing device 9 according to this embodiment includes a fixing belt 20, a pressure roller 21, and a heating device 19. The fixing belt 20 is an endless belt. The pressure roller 21 serves as an opposed rotator or an opposed member that contacts an outer circumferential surface of the fixing belt 20 to form a fixing nip N between the fixing belt 20 and the pressure roller 21. The heating device 19 heats the fixing belt 20 serving as a heated member or an object to be heated. The heating device 19 includes a heater 22 (e.g., a laminated heater), a heater holder 23, a stay 24, and a thermistor 25. The heater 22 is a laminated heater that serves as a heater or a heating member. The heater holder 23 serves as a holder that holds or supports the heater 22. The stay 24 serves as a support that supports the heater holder 23. The thermistor 25 serves as a temperature detector that detects the temperature of the fixing belt 20.

A detailed description is now given of a construction of the fixing belt 20.

The fixing belt 20 includes a tubular base that is made of polyimide (PI) and has an outer diameter of 25 mm and a thickness in a range of from 40 micrometers to 120 micrometers, for example. The fixing belt 20 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 micrometers to 50 micrometers to enhance durability of the fixing belt 20 and facilitate separation of the sheet P and a foreign substance from the fixing belt 20. Optionally, an elastic layer that is made of rubber or the like and has a thickness in a range of from 50 micrometers to 500 micrometers may be interposed between the base and the release layer. The base of the fixing belt 20 may be made of heat resistant resin such as polyetheretherketone (PEEK) or metal such as nickel (Ni) and SUS stainless steel, instead of polyimide. An inner circumferential surface of the fixing belt 20 may be coated with polyimide, PTFE, or the like to produce a slide layer.

A detailed description is now given of a construction of the pressure roller 21.

The pressure roller 21 has an outer diameter of 25 mm, for example. The pressure roller 21 includes a cored bar 21*a*, an elastic layer 21*b*, and a release layer 21*c*. The cored bar 21*a* is solid and made of metal such as iron. The elastic layer 21*b* coats the cored bar 21*a*. The release layer 21*c* coats an outer surface of the elastic layer 21*b*. The elastic layer 21*b* is made of silicone rubber and has a thickness of 3.5 mm, for example. In order to facilitate separation of the sheet P and the foreign substance from the pressure roller 21, the release layer 21*c* that is made of fluororesin and has a thickness of about 40 micrometers, for example, is preferably disposed on the outer surface of the elastic layer 21*b*.

A biasing member biases the pressure roller 21 toward the fixing belt 20, pressing the pressure roller 21 against the heater 22 via the fixing belt 20. Thus, the fixing nip N is formed between the fixing belt 20 and the pressure roller 21. A driver drives and rotates the pressure roller 21. As the pressure roller 21 rotates in a rotation direction indicated by an arrow in FIG. 2, the fixing belt 20 is driven and rotated by the pressure roller 21.

When printing starts, the driver drives and rotates the pressure roller 21 and the fixing belt 20 starts rotation in accordance with rotation of the pressure roller 21. Additionally, as power is supplied to the heater 22, the heater 22 heats the fixing belt 20. In a state in which the temperature of the fixing belt 20 reaches a predetermined target temperature (e.g., a fixing temperature), as the sheet P bearing the unfixed toner image is conveyed through the fixing nip N formed between the fixing belt 20 and the pressure roller 21 as illustrated in FIG. 2, the fixing belt 20 and the pressure roller 21 fix the unfixed toner image on the sheet P under heat and pressure.

A detailed description is now given of a construction of the heater 22.

The heater 22 extends in a longitudinal direction thereof throughout the fixing belt 20 in a width direction, that is, an axial direction, of the fixing belt 20. The heater 22 includes a base 30, a first insulating layer 32, two resistive heat generators 31, and a second insulating layer 33. The base 30 is platy. The first insulating layer 32 is disposed on the base 30. The two resistive heat generators 31 are disposed on the first insulating layer 32. The second insulating layer 33 covers the resistive heat generators 31. The heater 22 is constructed of the base 30, the first insulating layer 32, the resistive heat generators 31, and the second insulating layer 33 that are layered in this order toward the fixing belt 20 that faces the fixing nip N. Heat generated by the resistive heat generators 31 is conducted to the fixing belt 20 through the second insulating layer 33. According to this embodiment, a heater holder side face of the base 30, that does face the heater holder 23 and does not face the fixing belt 20 at the fixing nip N, does not mount an insulating layer. Alternatively, the heater holder side face of the base 30 may also mount the insulating layer.

According to this embodiment, the resistive heat generators 31 are disposed on a fixing belt side face of the base 30, that faces the fixing belt 20 and the fixing nip N. Conversely, the resistive heat generators 31 may be disposed on the heater holder side face that is opposite the fixing belt side face of the base 30. In this case, since heat is conducted from the resistive heat generators 31 to the fixing belt 20 through the base 30, the base 30 is preferably made of a material having an increased thermal conductivity such as aluminum nitride. With the base 30 made of the material having the increased thermal conductivity, even if the resistive heat generators 31 are disposed opposite the fixing belt 20 via the base 30, the resistive heat generators 31 heat the fixing belt 20 sufficiently.

A detailed description is now given of a construction of the heater holder 23 and the stay 24.

The heater holder 23 and the stay 24 are disposed inside a loop formed by the fixing belt 20. The stay 24 includes a channel made of metal. Both lateral ends of the stay 24 in a longitudinal direction thereof are supported by side plates of the fixing device 9, respectively. Since the stay 24 supports the heater holder 23 and the heater 22 supported by the heater holder 23, in a state in which the pressure roller 21 is pressed against the fixing belt 20, the heater 22 receives pressure from the pressure roller 21 precisely to form the fixing nip N stably.

Since the heater holder 23 is subject to temperature increase by heat from the heater 22, the heater holder 23 is preferably made of a heat resistant material. For example, if the heater holder 23 is made of heat resistant resin having a decreased thermal conductivity, such as liquid crystal polymer (LCP), the heater holder 23 suppresses conduction of heat thereto from the heater 22, heating the fixing belt 20 effectively. In order to decrease a contact area where the heater holder 23 contacts the heater 22 and thereby reduce an amount of heat conducted from the heater 22 to the heater holder 23, the heater holder 23 includes projections 23*a* that contact the heater 22.

Figure 3:
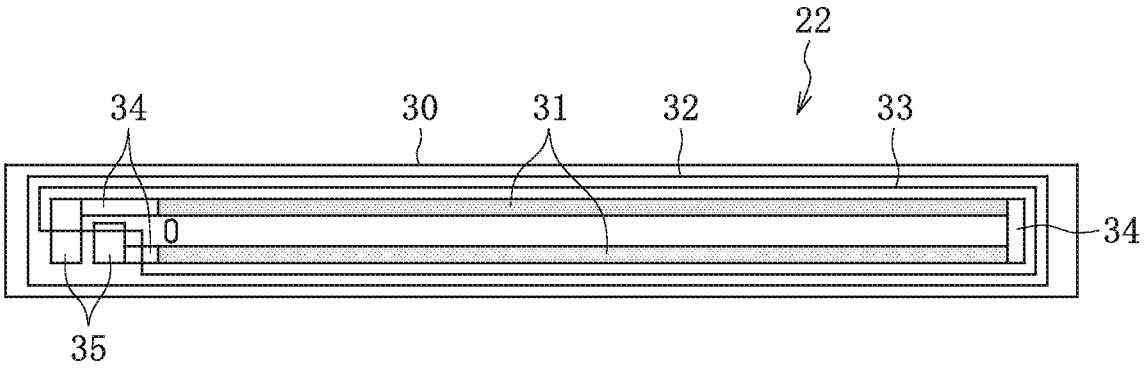
FIG. 3 is a plan view of a heater incorporated in the fixing device depicted in FIG. 2.
Figure 4:
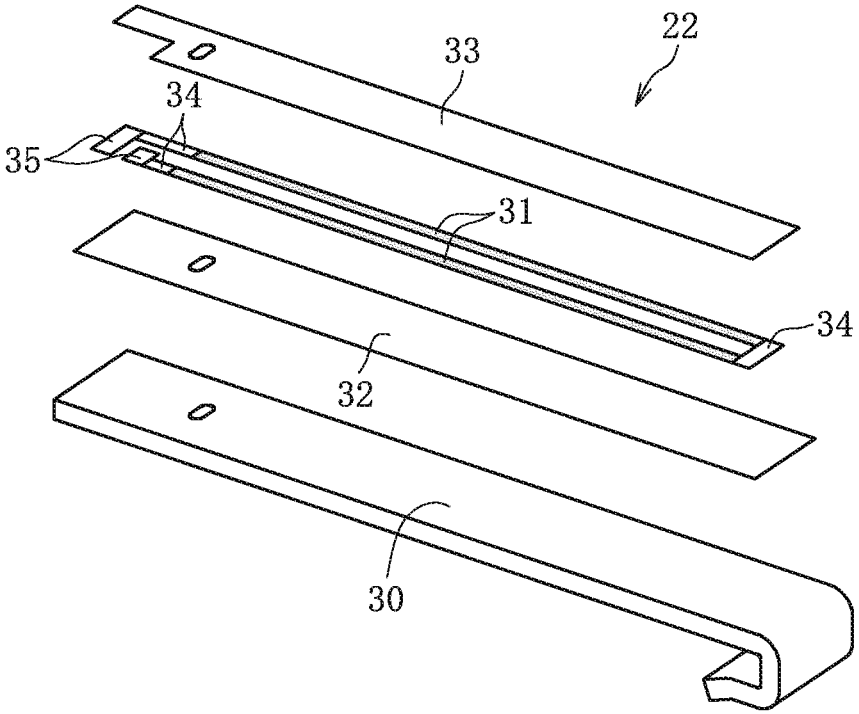
FIG. 4 is an exploded perspective view of the heater depicted in FIG. 3.

FIG. 3 is a plan view of the heater 22 according to this embodiment. FIG. 4 is an exploded perspective view of the heater 22.

As illustrated in FIGS. 3 and 4, the two resistive heat generators 31 extend in a longitudinal direction of the base 30. One end (e.g., a right end in FIG. 3) of one of the resistive heat generators 31 is coupled to one end of another one of the resistive heat generators 31 through a feeder 34. The feeder 34 is made of a conductor having a resistance value smaller than a resistance value of the resistive heat generators 31. Another end (e.g., a left end in FIG. 3) of each of the resistive heat generators 31 is coupled to an electrode 35 through another feeder 34. The resistive heat generators 31, the feeders 34, and the electrodes 35 are disposed on the first insulating layer 32. The second insulating layer 33 covers the feeders 34 and the electrodes 35 partially, in addition to the resistive heat generators 31.

The base 30 is preferably made of a material that conducts heat from the resistive heat generators 31 to the fixing belt 20 effectively, reduces variation in temperature of the fixing belt 20, and improves fixing, for example, aluminum that is available at reduced costs and has an increased thermal conductivity. Alternatively, instead of aluminum, the base 30 may be made of metal such as stainless steel and iron. Instead of metal, the base 30 may be made of glass, ceramic, or the like.

For example, the resistive heat generators 31 are produced as below. Silver-palladium (AgPd), glass powder, and the like are mixed into paste. The paste coats the base 30 by screen printing or the like. Thereafter, the base 30 is subject to firing. Alternatively, the resistive heat generators 31 may be made of a resistive material such as a silver alloy (AgPt) and ruthenium oxide ($RuO_2$). The feeders 34 and the electrodes 35 are made of a material prepared with silver (Ag) or silver-palladium (AgPd) by screen printing or the like. The first insulating layer 32 and the second insulating layer 33 are made of heat resistant glass, ceramic, polyimide (PI), or the like.

Figure 5:
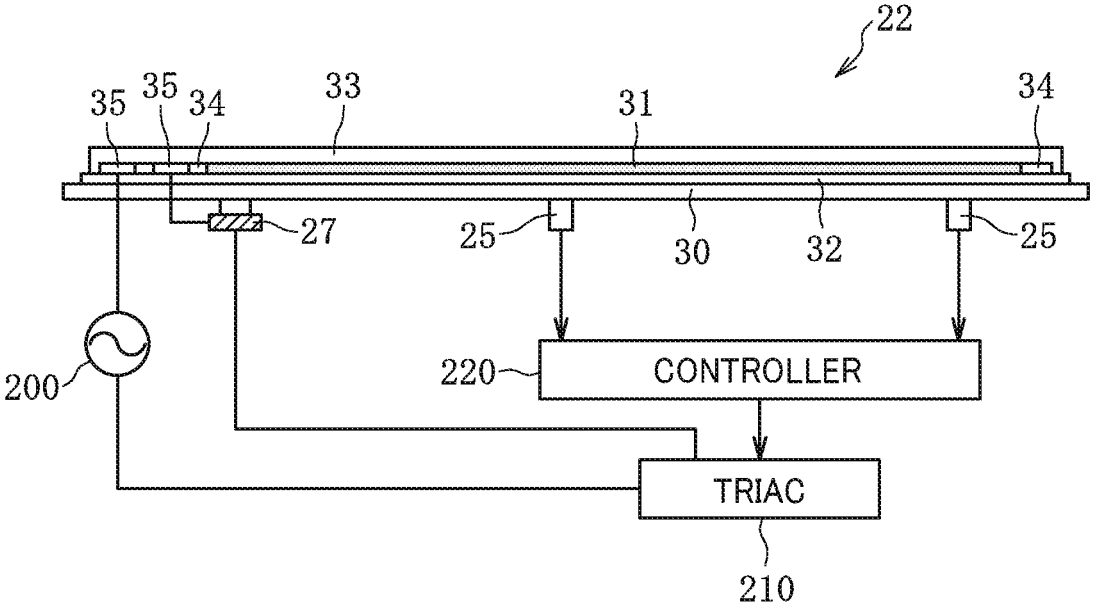
FIG. 5 is a diagram of the heater depicted in FIG. 4, illustrating a power supply circuit that supplies power to the heater.

FIG. 5 is a diagram of the heater 22 according to this embodiment, illustrating a power supply circuit that supplies power to the heater 22.

As illustrated in FIG. 5, according to this embodiment, the power supply circuit for supplying power to each of the resistive heat generators 31 is constructed by electrically connecting an alternating current power supply 200 to the electrodes 35 of the heater 22. The power supply circuit includes a triac 210 that controls an amount of power supplied to each of the resistive heat generators 31. A controller 220 controls the amount of power supplied to each of the resistive heat generators 31 through the triac 210 based on a temperature of the resistive heat generator 31, that is detected by each of the thermistors 25 serving as a temperature detector. The controller 220 includes a microcomputer that includes a central processing unit (CPU), a read-only memory (ROM), a random access memory (RAM), and an input-output (I/O) interface.

According to this embodiment, the thermistors 25 serving as temperature detectors are disposed opposite a center span of the heater 22 in the longitudinal direction thereof, that is, a minimum sheet conveyance span where a minimum size sheet P is conveyed, and one lateral end span of the heater 22 in the longitudinal direction thereof, respectively. Further, a thermostat 27 serving as a power interrupter is disposed at one end of the heater 22 in the longitudinal direction thereof. The thermostat 27 interrupts supplying power to the resistive heat generators 31 when a temperature of the resistive heat generators 31 is a predetermined temperature or higher. The thermistors 25 and the thermostat 27 contact the base 30 to detect the temperature of the resistive heat generators 31.

Figure 6:
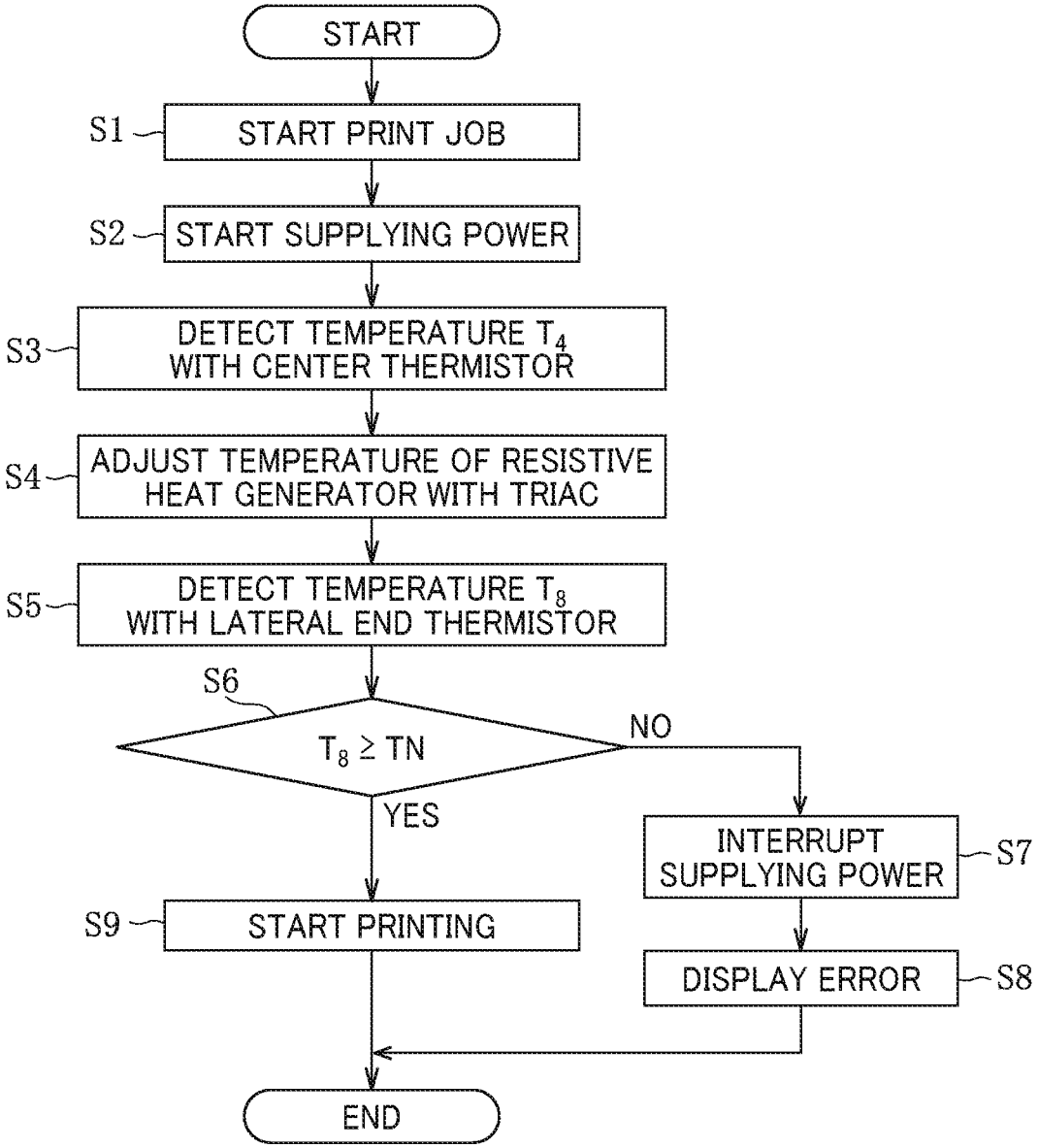
FIG. 6 is a flowchart illustrating control processes to control the heater depicted in FIG. 5.

Referring to FIG. 6 illustrating a flowchart, a description is provided of control processes for controlling the heater 22 according to this embodiment.

As illustrated in FIG. 6, in step S1, the image forming apparatus 100 starts a print job. In step S2, the controller 220 causes the alternating current power supply 200 to start supplying power to each of the resistive heat generators 31 of the heater 22. Accordingly, each of the resistive heat generators 31 starts generating heat, heating the fixing belt 20. In step S3, the thermistor 25, that is, a center thermistor, disposed opposite the center span of the heater 22 in the longitudinal direction thereof, detects a temperature $T_4$ of the resistive heat generator 31. In step S4, based on the temperature $T_4$ sent from the thermistor 25, that is, the center thermistor, the controller 220 controls the triac 210 to adjust the amount of power supplied to each of the resistive heat generators 31 so that each of the resistive heat generators 31 attains a predetermined temperature.

Simultaneously, in step S5, the thermistor 25, that is, a lateral end thermistor, disposed opposite the lateral end span of the heater 22 in the longitudinal direction thereof, also detects a temperature $T_8$ of the resistive heat generator 31. In step S6, the controller 220 determines whether or not the temperature $T_8$ of the resistive heat generator 31, that is detected by the thermistor 25 serving as the lateral end thermistor, is a predetermined temperature TN or higher ($T_8 \geq TN$). If the controller 220 determines that the temperature $T_8$ of the resistive heat generator 31 is lower than the predetermined temperature TN (NO in step S6), the controller 220 determines that an abnormally decreased temperature (e.g., disconnection) generates and interrupts supplying power to the heater 22 in step S7. In step S8, the controller 220 causes a control panel of the image forming apparatus 100 to display an error. Conversely, if the controller 220 determines that the temperature $T_8$ of the resistive heat generator 31, that is detected by the thermistor 25, is the predetermined temperature TN or higher (YES in step S6), the controller 220 determines that no abnormally decreased temperature generates and starts printing in step S9.

If the controller 220 does not perform temperature control based on the temperature detected by the thermistors 25, that is, the center thermistor and the lateral end thermistor, the resistive heat generators 31 may suffer from an abnormally increased temperature. In this case, when the temperature of the resistive heat generators 31 reaches the predetermined temperature or higher, the controller 220 activates the thermostat 27 to interrupt supplying power to the resistive heat generators 31, preventing the resistive heat generators 31 from suffering from the abnormally increased temperature.

A description is provided of a holding mechanism of the heater holder 23 to hold the heater 22.

Figure 7:
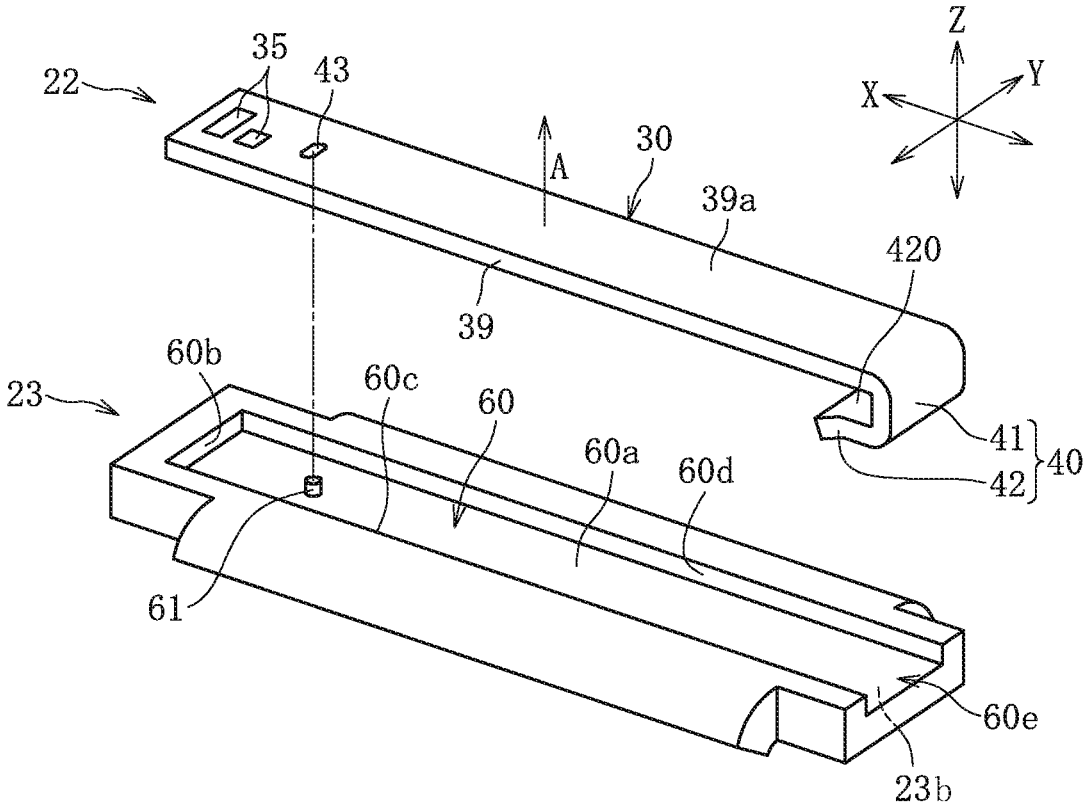
FIG. 7 is a perspective view of the heater and a heater holder according to a first embodiment of the present disclosure, that are incorporated in the fixing device depicted in FIG. 2.

FIG. 7 is a perspective view of the heater 22 according to a first embodiment, that is separated from the heater holder 23.

FIG. 7 omits the resistive heat generators 31, the feeders 34, the first insulating layer 32, and the second insulating layer 33. As illustrated in FIG. 7, according to this embodiment, each of the heater 22 and the heater holder 23 is an elongated plate extending in one direction. Accordingly, in the description of the heater 22 and the heater holder 23 below, the one direction in which the heater 22 and the heater holder 23 extend (e.g., X-direction) defines a longitudinal direction. A direction (e.g., Y-direction) that is perpendicular to the longitudinal direction and parallel to a contact face 39*a* of the heater 22, that contacts the fixing belt 20, defines a short direction. A direction (e.g., Z-direction) that is perpendicular to the longitudinal direction and the short direction defines a thickness direction.

As illustrated in FIG. 7, the base 30 of the heater 22 includes a body 39 and a bent portion 40. The body 39 is a flat plate that is rectangular. The bent portion 40 is bent from one end of the body 39 in the longitudinal direction. The body 39 includes the contact face 39*a* that contacts the fixing belt 20 serving as a heated member or an object to be heated and mounts the electrodes 35, the resistive heat generators 31, and the like. The bent portion 40 includes a primary bent portion 41 and a secondary bent portion 42. The primary bent portion 41 is bent from one end of the body 39 in the longitudinal direction in a direction opposite a separating direction A in which the heater 22 separates from the heater holder 23. The secondary bent portion 42 is bent from the primary bent portion 41 toward the electrodes 35 in a direction perpendicular to the primary bent portion 41. The separating direction A in which the heater 22 separates from the heater holder 23 defines a direction perpendicular to the contact face 39*a* of the heater 22, that is, the thickness direction.

The heater holder 23 includes a recess 60 disposed on an opposed face that is disposed opposite the heater 22. The recess 60 accommodates the body 39 of the base 30. The recess 60 includes a bottom face 60*a* and three side faces 60*b*, 60*c*, and 60*d*. The bottom face 60*a* defines a rectangle that is equivalent to the body 39 of the base 30 in size. The three side faces 60*b*, 60*c*, and 60*d* are perpendicular to the bottom face 60*a*. The recess 60 does not have a side face on one short side and has a longitudinal direction aperture 60*e* that extends in the longitudinal direction.

A projection 61 is disposed in proximity to another short side of the recess 60 opposite the one short side where the longitudinal direction aperture 60*e* is disposed. The projection 61 positions the heater 22 with respect to the heater holder 23. A positioning hole 43 is disposed in the body 39 of the heater 22. The positioning hole 43 serves as a positioner that engages the projection 61 of the heater holder 23. According to this embodiment, the positioning hole 43 is a rectangular hole elongated in the short direction of the heater 22. Alternatively, in contrast to this embodiment, a projection serving as a positioner may be disposed in the heater 22 and a positioning hole that engages the projection may be disposed in the heater holder 23. Further, the positioning hole may be a hole having a bottom, instead of a through hole.

A description is provided of a method for attaching the heater 22 to the heater holder 23.

Figure 8:
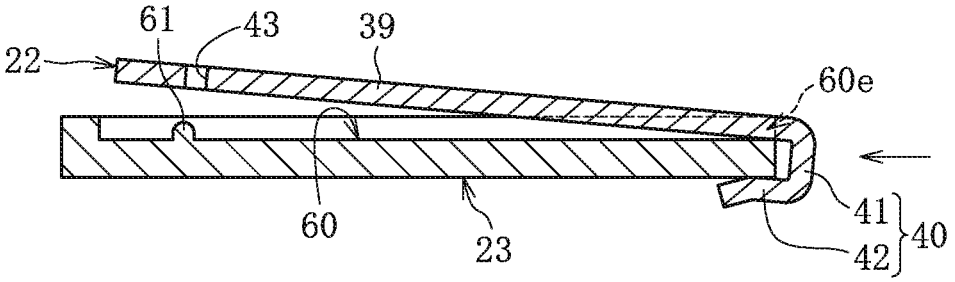
FIG. 8 is a cross-sectional view of the heater and the heater holder depicted in FIG. 7, illustrating a process of a method for attaching the heater to the heater holder.
Figure 9:
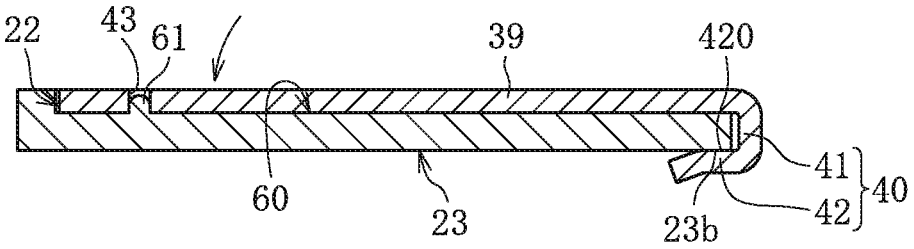
FIG. 9 is a cross-sectional view of the heater and the heater holder depicted in FIG. 7, illustrating another process of the method for attaching the heater to the heater holder.

First, as illustrated in FIG. 8, the heater 22 is moved closer to the heater holder 23 in the longitudinal direction. The bent portion 40 of the heater 22 engages an aperture side end of the heater holder 23 in the longitudinal direction, which is provided with the longitudinal direction aperture 60*e*. If a tip of the secondary bent portion 42 has a slope like this embodiment, the tip of the secondary bent portion 42 does not easily interfere with a back face of the heater holder 23, that is, a face that does not face the body 39 of the heater 22 and is directed in a direction opposite the separating direction A, thus facilitating engagement of the bent portion 40 with the heater holder 23. The heater 22 pivots about an engagement point where the bent portion 40 of the heater 22 engages the aperture side end of the heater holder 23, that is provided with the longitudinal direction aperture 60*e*, in a pivot direction indicated with an arrow in FIG. 9. The heater 22 is placed in the recess 60 of the heater holder 23 such that the projection 61 of the heater holder 23 is inserted into the positioning hole 43 of the heater 22. As the projection 61 engages the positioning hole 43, the projection 61 and the positioning hole 43 restrict motion of the heater 22 with respect to the heater holder 23 in the longitudinal direction.

As the bent portion 40 of the heater 22 engages the aperture side end of the heater holder 23, that is provided with the longitudinal direction aperture 60*e*, motion of the heater 22 with respect to the heater holder 23 in the separating direction A is restricted at the bent portion 40. For example, according to this embodiment, among faces of the primary bent portion 41 and the secondary bent portion 42 that construct the bent portion 40, a front face 420 of the secondary bent portion 42 engages a back face 23*b* of the heater holder 23. The front face 420 serves as a separating direction face which is directed in the separating direction A, that is, an upper face of the secondary bent portion 42 in FIGS. 7 and 9. The back face 23*b* serves as an engaged face which is directed in the direction opposite the separating direction A, that is, a lower face of the heater holder 23 in FIGS. 7 and 9.

Accordingly, the front face 420 serves as a separation restrictor that restricts motion of the heater 22 with respect to the heater holder 23 in the separating direction A. The front face 420 serving as a separation restrictor is disposed at one end of the heater 22 in the longitudinal direction thereof. The positioning hole 43 serving as a positioner is disposed at another end of the heater 22 in the longitudinal direction thereof.

Figure 10:
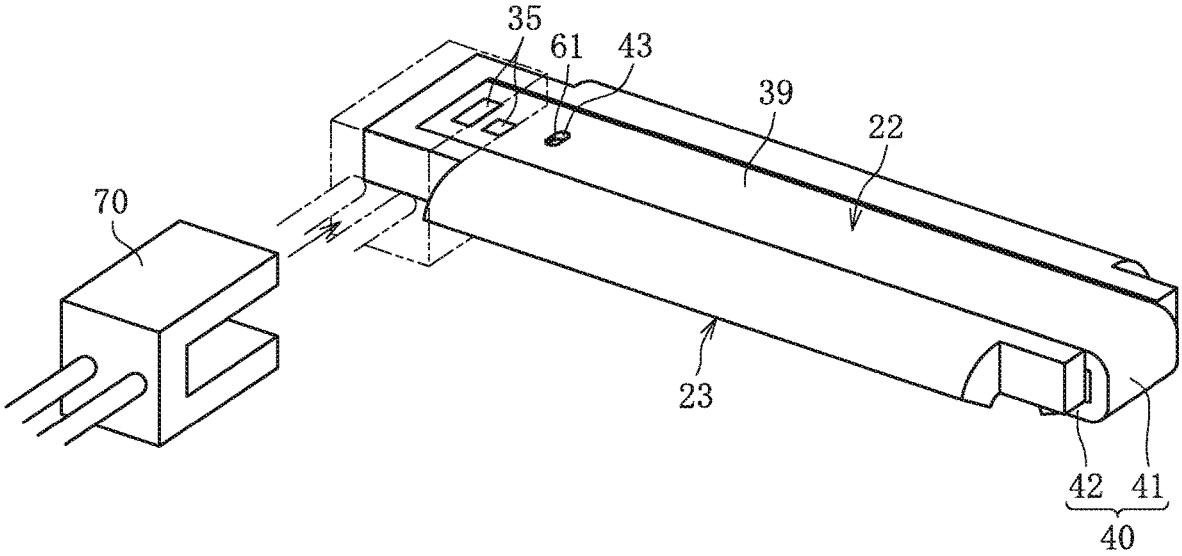
FIG. 10 is a perspective view of the heater and the heater holder depicted in FIG. 9, which are sandwiched by a connector.

Finally, as illustrated in FIG. 10, while the heater 22 is attached to the heater holder 23, a connector 70 is attached to an electrode side end of the heater 22, which is provided with the electrodes 35, such that the connector 70 sandwiches the heater 22 and the heater holder 23. Accordingly, a contact terminal of the connector 70 is electrically connected to the electrodes 35 of the heater 22. The heater 22 is secured to the heater holder 23 at the electrode side end of the heater 22, which is opposite a bent portion side end of the heater 22 where the bent portion 40 is disposed. For example, engagement of the bent portion 40 with the heater holder 23 at one end of the heater 22 in the longitudinal direction and sandwiching of the heater 22 and the heater holder 23 by the connector 70 at another end of the heater 22 in the longitudinal direction hold the heater 22 such that the heater 22 does not separate from the heater holder 23 in the separating direction A. Accordingly, since separation of the heater 22 from the heater holder 23 is restricted, when pressure applied at the fixing nip N is released to remove a jammed sheet P from the fixing nip N, for example, even if the heater 22 vibrates, the heater 22 does not drop off or separate from the heater holder 23 in the separating direction A.

When the fixing belt 20 rotates in accordance with rotation of the pressure roller 21, the fixing belt 20 biases the heater 22 downstream in a rotation direction of the fixing belt 20, thus positioning the heater 22 with respect to the heater holder 23 in the short direction. For example, according to this embodiment, since the positioning hole 43 of the heater 22 is elongated in the short direction as illustrated in FIG. 7, the positioning hole 43 allows the heater 22 to move downstream in the rotation direction of the fixing belt 20. As the heater 22 comes into contact with one (e.g., a downstream one in the rotation direction of the fixing belt 20) of the side faces 60*c* and 60*d* that are elongated in the longitudinal direction and construct the recess 60 of the heater holder 23, motion of the heater 22 is restricted and the heater 22 is positioned in the short direction. Alternatively, engagement of the projection 61 with the positioning hole 43 may perform positioning of the heater 22 in an arbitrary direction parallel to the contact face 39*a* as well as positioning of the heater 22 in the short direction.

As described above, according to this embodiment, the front face 420 is disposed at one lateral end of the heater 22 in the longitudinal direction. The front face 420 serving as a separation restrictor engages the heater holder 23 to restrict motion of the heater 22 with respect to the heater holder 23 in the separating direction A. Accordingly, even if a heater clip or the like is not provided separately, the front face 420 restricts separation of the heater 22 from the heater holder 23 at one lateral end of the heater 22 in the longitudinal direction. Consequently, the heating device 19 decreases the number of parts, reducing manufacturing costs. Additionally, compared to a configuration in which the heater holder 23 holds the heater 22 with a separate member such as the heater clip, the heater 22 is attached to the heater holder 23 readily. For example, according to this embodiment, the heater 22 pivots about an engagement point where the bent portion 40 engages the heater holder 23 to attach the heater 22 to the heater holder 23, facilitating and simplifying attachment of the heater 22 to the heater holder 23.

According to this embodiment, the bent portion 40 (e.g., the primary bent portion 41) is bent from the body 39 toward the heater holder 23, not toward the fixing belt 20 and the fixing nip N. That is, the bent portion 40 is bent in a direction opposite a direction directed to the fixing belt 20 and the fixing nip N. Hence, the bent portion 40 does not interfere with the fixing belt 20 easily. Additionally, the heater 22 is installed inside the loop formed by the fixing belt 20 readily for assembly.

As described above, the base 30 of the heater 22 is made of a plastic material such as glass and ceramic in addition to metal. However, the base 30 is preferably made of metal, for example, in view of processing and costs. With the base 30 made of metal, the primary bent portion 41 and the secondary bent portion 42 according to this embodiment are produced readily.

According to this embodiment, the first insulating layer 32 and the second insulating layer 33 are produced by a spraying method for spraying an insulating material onto the base 30 to coat the base 30 with the insulating material. However, with the spraying method, it is difficult to produce the first insulating layer 32 and the second insulating layer 33 in the primary bent portion 41 that is different from the body 39 in height (e.g., a position in the thickness direction). To address this circumstance, according to this embodiment, the first insulating layer 32 and the second insulating layer 33 are disposed in the body 39 and are not disposed in the primary bent portion 41.

The following describes embodiments different from the embodiments described above.

Hereinafter, the embodiments are described mainly of configurations that are different from those of the embodiments described above. A description of other configurations that are basically common to the embodiments described above is omitted.

Figure 11:
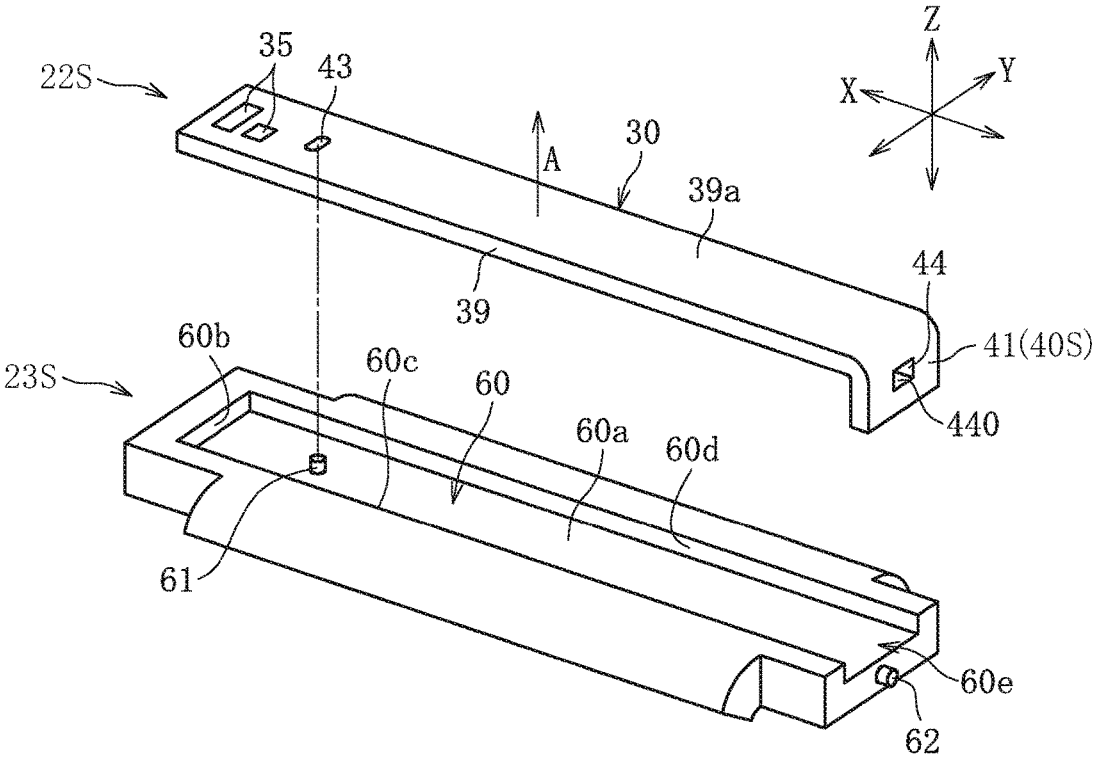
FIG. 11 is a perspective view of a heater and a heater holder according to a second embodiment of the present disclosure, that are installable in the fixing device depicted in FIG. 2.

FIG. 11 is a perspective view of a heater 22S and a heater holder 23S according to a second embodiment of the present disclosure. As described above, X-direction, Y-direction, and Z-direction in FIG. 11 indicate the longitudinal direction, the short direction, and the thickness direction, respectively. Similarly, X-direction, Y-direction, and Z-direction in drawings referred to in a description below indicate the longitudinal direction, the short direction, and the thickness direction, respectively.

The heater 22S according to the second embodiment illustrated in FIG. 11 includes a bent portion 40S disposed at one end of the heater 22S in the longitudinal direction. The bent portion 40S includes the primary bent portion 41. That is, the bent portion 40S according to this embodiment does not include the secondary bent portion 42. Additionally, according to this embodiment, a hole 44 is disposed in the primary bent portion 41. The heater holder 23S includes a projection 62 that projects in the longitudinal direction. The projection 62 is mounted on an end portion of an aperture side end of the heater holder 23S, that is provided with the longitudinal direction aperture 60*e*.

A description is provided of a method for attaching the heater 22S to the heater holder 23S according to the second embodiment.

Figure 12:
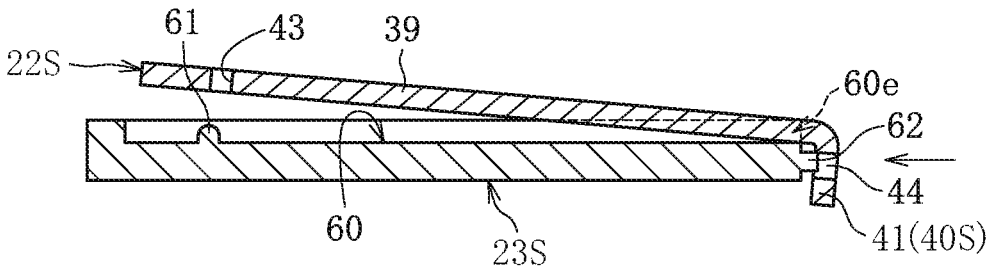
FIG. 12 is a cross-sectional view of the heater and the heater holder depicted in FIG. 11, illustrating a process of a method for attaching the heater to the heater holder.

First, as illustrated in FIG. 12, the projection 62 of the heater holder 23S is inserted into and engaged with the hole 44 disposed in the primary bent portion 41 of the heater 22S. The heater 22S pivots about an engagement point where the projection 62 engages the hole 44 in a pivot direction indicated with an arrow in FIG. 13. Accordingly, the recess 60 of the heater holder 23S accommodates the heater 22S and the projection 61 of the heater holder 23S is inserted into the positioning hole 43 of the heater 22S. Similarly to the first embodiment described above, the connector 70 is attached to one end of the heater 22S where the electrodes 35 are disposed.

Figure 13:
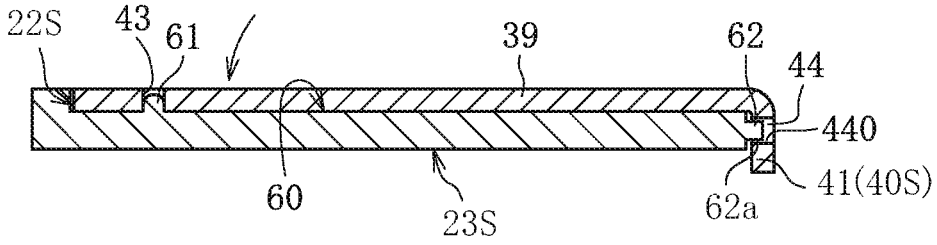
FIG. 13 is a cross-sectional view of the heater and the heater holder depicted in FIG. 11, illustrating another process of the method for attaching the heater to the heater holder.

As described above, while the heater holder 23S holds the heater 22S, as the hole 44 of the heater 22S engages the projection 62 of the heater holder 23S, motion of the heater 22S with respect to the heater holder 23S in the separating direction A is restricted. For example, according to this embodiment, among faces that construct the hole 44 of the heater 22S, a front face 440 serving as a separating direction face that is directed in the separating direction A as illustrated in FIGS. 11 and 13 engages a back face 62*a*, serving as an engaged portion or an engaged face, of the projection 62, which is directed in the direction opposite the separating direction A. Accordingly, the front face 440 serves as a separation restrictor that restricts motion of the heater 22S with respect to the heater holder 23S in the separating direction A.

Figure 14:
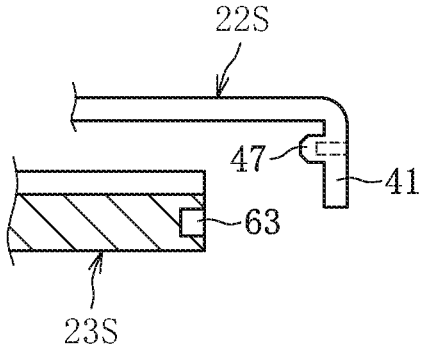
FIG. 14 is a cross-sectional view of the heater and the heater holder depicted in FIG. 13 as a modification example.

Alternatively, like a modification example illustrated in FIG. 14, in contrast to the above-described configuration of the heater 22S and the heater holder 23S, the heater 22S may include a projection 47 that projects in the longitudinal direction and is produced by embossing or the like, for example. The heater holder 23S may include a hole 63 depressed in the longitudinal direction. With this configuration also, engagement of the projection 47 with the hole 63 restricts motion of the heater 22S with respect to the heater holder 23S in the separating direction A. Alternatively, the hole 44 of the heater 22S and the hole 63 of the heater holder 23S may be a hole having a bottom, instead of a through hole.

According to this embodiment, like the first embodiment described with reference to FIGS. 7 to 10, the primary bent portion 41 of the heater 22S is bent from the body 39 toward the heater holder 23S, not toward the fixing belt 20 and the fixing nip N. That is, the primary bent portion 41 is bent in the direction opposite the direction directed to the fixing belt 20 and the fixing nip N. Hence, the bent portion 40S does not interfere with the fixing belt 20 easily, facilitating installation of the heater 22S. Additionally, according to this embodiment, since the heater 22S does not incorporate the secondary bent portion 42, a length of the base 30 of the heater 22S is smaller than a length of the base 30 of the heater 22 according to the first embodiment, attaining similar advantages at reduced manufacturing costs. The shortened length of the base 30 decreases the thermal capacity of the base 30, saving energy.

Figure 15:
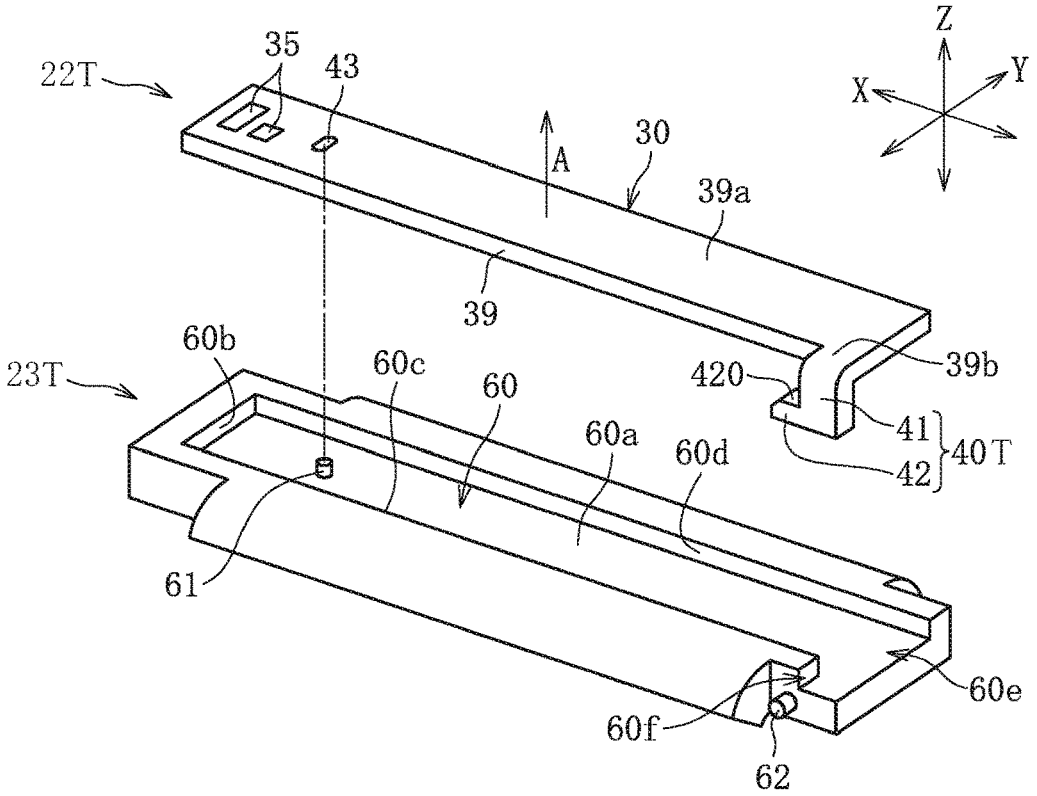
FIG. 15 is a perspective view of a heater and a heater holder according to a third embodiment of the present disclosure, that are installable in the fixing device depicted in FIG. 2.

FIG. 15 is a perspective view of a heater 22T and a heater holder 23T according to a third embodiment of the present disclosure.

The heater 22T according to the third embodiment illustrated in FIG. 15 includes the body 39 mounting a tab 39*b* projecting from one end of the body 39 in the longitudinal direction. The tab 39*b* defines an identical plane with the body 39 and projects in the short direction from one end of the body 39 in the short direction. The identical plane is defined as a greatest one in area of planes of the body 39, which are directed in three directions and perpendicular to each other. The identical plane described below is defined similarly.

Additionally, according to this embodiment, the tab 39*b* mounted on the body 39 mounts a bent portion 40T. The bent portion 40T includes the primary bent portion 41 and the secondary bent portion 42. The primary bent portion 41 is bent from the tab 39*b* in the direction opposite the separating direction A in which the heater 22T separates from the heater holder 23T. The secondary bent portion 42 is bent from the primary bent portion 41 toward the electrodes 35 mounted on the body 39. The heater holder 23T includes the projection 62 disposed in proximity to an end portion of an aperture side end of the heater holder 23T, that is provided with the longitudinal direction aperture 60*e*. The projection 62 projects in the short direction. The heater holder 23T includes a short direction aperture 60*f* that extends in the short direction. In order to prevent the heater holder 23T from interfering with the tab 39*b* mounted on the body 39 at the aperture side end of the heater holder 23T, that is provided with the longitudinal direction aperture 60*e*, a part of the side face 60*c* as one of elongated side portions that define the recess 60 is cut out to produce the short direction aperture 60*f* that extends in the short direction.

A description is provided of a method for attaching the heater 22T to the heater holder 23T according to the third embodiment.

Figure 16:
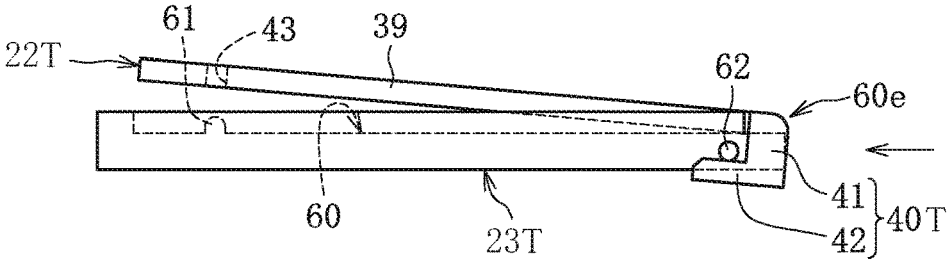
FIG. 16 is a cross-sectional view of the heater and the heater holder depicted in FIG. 15, illustrating a process of a method for attaching the heater to the heater holder.

As illustrated in FIG. 16, first, the bent portion 40T of the heater 22T engages the projection 62 disposed in proximity to the longitudinal direction aperture 60*e* of the heater holder 23T. The heater 22T pivots about an engagement point where the bent portion 40T of the heater 22T engages the projection 62 of the heater holder 23T in a pivot direction indicated with an arrow in FIG. 17. Accordingly, the recess 60 of the heater holder 23T accommodates the heater 22T and the projection 61 of the heater holder 23T is inserted into the positioning hole 43 of the heater 22T. Similarly to the embodiments described above, the connector 70 is attached to one end of the heater 22T where the electrodes 35 are disposed.

Figure 17:
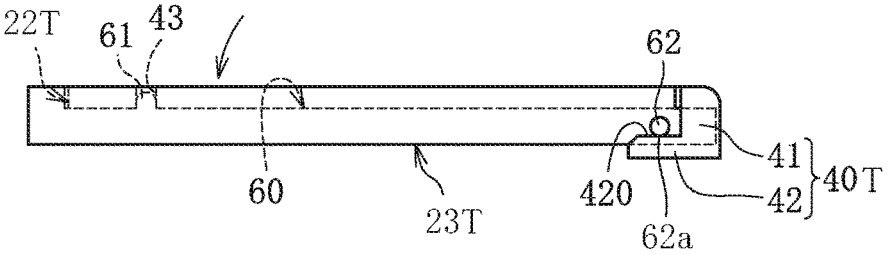
FIG. 17 is a cross-sectional view of the heater and the heater holder depicted in FIG. 15, illustrating another process of the method for attaching the heater to the heater holder.

As described above, while the heater holder 23T holds the heater 22T, as the bent portion 40T of the heater 22T engages the projection 62 of the heater holder 23T, motion of the heater 22T with respect to the heater holder 23T in the separating direction A is restricted. For example, according to this embodiment, among faces of the bent portion 40T of the heater 22T, the front face 420 of the secondary bent portion 42, which is directed in the separating direction A as illustrated in FIGS. 15 and 17, engages the back face 62*a*, serving as an engaged portion or an engaged face, of the projection 62, which is directed in the direction opposite the separating direction A. Accordingly, the front face 420 serves as a separation restrictor that restricts motion of the heater 22T with respect to the heater holder 23T in the separating direction A.

According to this embodiment also, like the embodiments described above, the primary bent portion 41 of the heater 22T is bent from the tab 39*b* mounted on the body 39 toward the heater holder 23T, not toward the fixing belt 20 and the fixing nip N. That is, the primary bent portion 41 is bent in the direction opposite the direction directed to the fixing belt 20 and the fixing nip N. Hence, the bent portion 40T does not interfere with the fixing belt 20 easily, facilitating installation of the heater 22T. According to this embodiment, the bent portion 40T is disposed outboard from the body 39 in the short direction. Accordingly, compared to the embodiments described above, the heater 22T is upsized in the short direction. However, the heater 22T is downsized in the longitudinal direction. Additionally, according to this embodiment, since the bent portion 40T is downsized, the thermal capacity of the base 30 decreases, saving energy.

Figure 18:
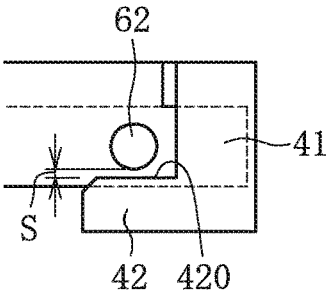
FIG. 18 is a cross-sectional view of the heater and the heater holder depicted in FIG. 17 as a modification example in which a gap is provided between a secondary bent portion incorporated in the heater and a projection incorporated in the heater holder.

Alternatively, like a modification example illustrated in FIG. 18, while the heater 22T is attached to the heater holder 23T, a gap S (e.g., looseness) may be provided between the secondary bent portion 42 serving as a separation restrictor of the heater 22T and the projection 62 serving as an engaged portion of the heater holder 23T. In this case, the heater 22T is attached to the heater holder 23T readily.

Figure 19:
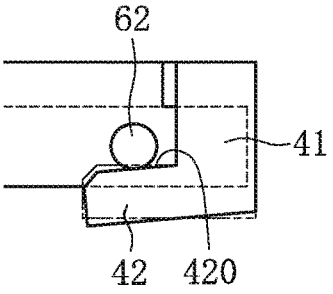
FIG. 19 is a cross-sectional view of the heater and the heater holder depicted in FIG. 17 as another modification example in which at least one of the secondary bent portion and the projection deforms elastically to contact each other.

Alternatively, conversely, like a modification example illustrated in FIG. 19, the gap S (e.g., looseness) may not be provided between the secondary bent portion 42 serving as a separation restrictor of the heater 22T and the projection 62 serving as an engaged portion of the heater holder 23T. At least one of the secondary bent portion 42 and the projection 62 may deform elastically to contact each other. In this case, an elastic force increases adhesion of the heater 22T to the heater holder 23T. A configuration in which the gap S is provided between the separation restrictor and the engaged portion and a configuration in which at least one of the secondary bent portion 42 and the projection 62 deforms elastically to adhere to each other may be selectively employed properly in other embodiments also.

Figure 20:
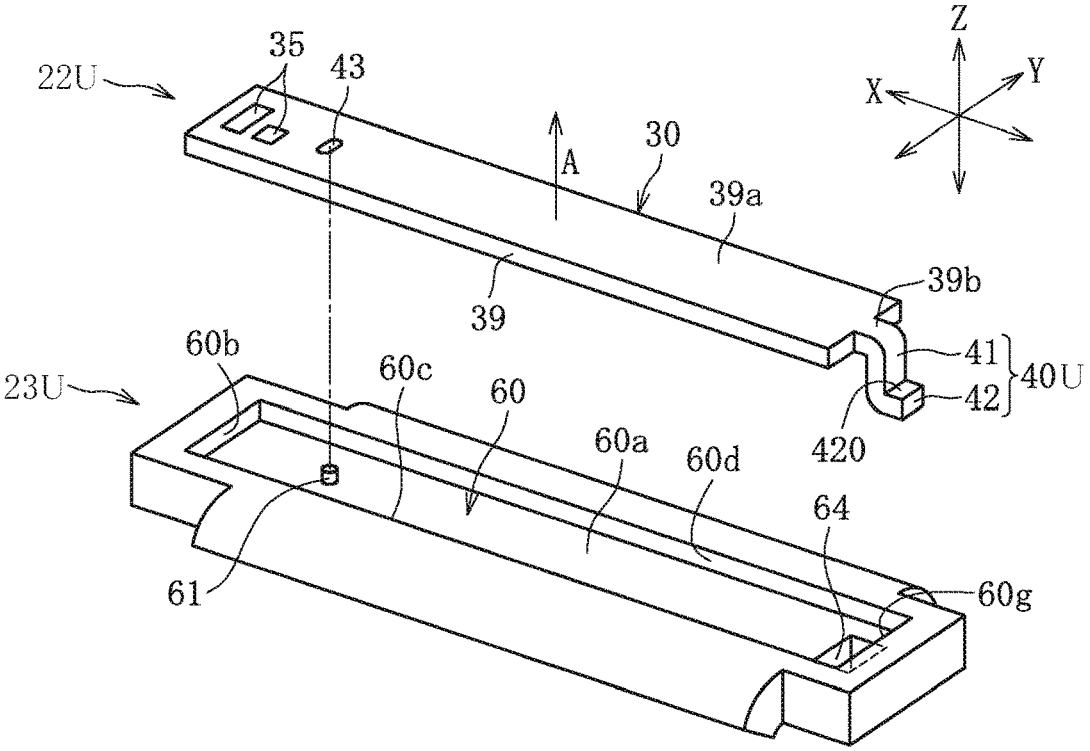
FIG. 20 is a perspective view of a heater and a heater holder according to a fourth embodiment of the present disclosure, that are installable in the fixing device depicted in FIG. 2.

FIG. 20 is a perspective view of a heater 22U and a heater holder 23U according to a fourth embodiment of the present disclosure.

The heater 22U according to the fourth embodiment illustrated in FIG. 20 includes the body 39 mounting the tab 39*b* projecting from one end of the body 39 in the longitudinal direction. The tab 39*b* defines an identical plane with the body 39 and projects in the longitudinal direction from one end of the body 39 in the longitudinal direction. The tab 39*b* mounts a bent portion 40U including the primary bent portion 41 and the secondary bent portion 42. The primary bent portion 41 is bent from the tab 39*b* in the direction opposite the separating direction A in which the heater 22U separates from the heater holder 23U. The secondary bent portion 42 is bent from the primary bent portion 41 in a direction opposite a direction directed to the electrodes 35 mounted on the body 39. A hole 64 is disposed in the bottom face 60*a* of the recess 60 of the heater holder 23U. The hole 64 is disposed at one end of the heater holder 23U in the longitudinal direction such that the hole 64 is disposed opposite the bent portion 40U of the heater 22U. One end of the recess 60 in the longitudinal direction does not open to produce a space extending in the longitudinal direction. That is, the recess 60 does not define the longitudinal direction aperture 60*e* depicted in FIG. 15. The recess 60 includes a side face 60*g*.

A description is provided of a method for attaching the heater 22U to the heater holder 23U according to the fourth embodiment.

Figure 21:
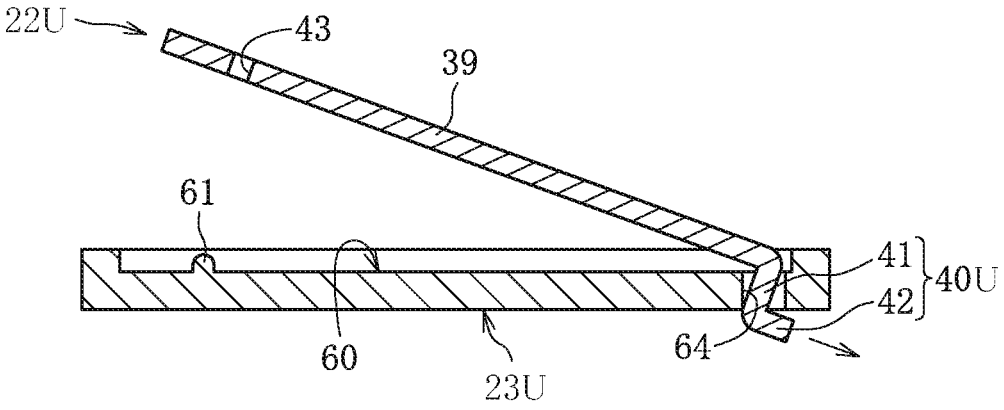
FIG. 21 is a cross-sectional view of the heater and the heater holder depicted in FIG. 20, illustrating a process of a method for attaching the heater to the heater holder.
Figure 22:
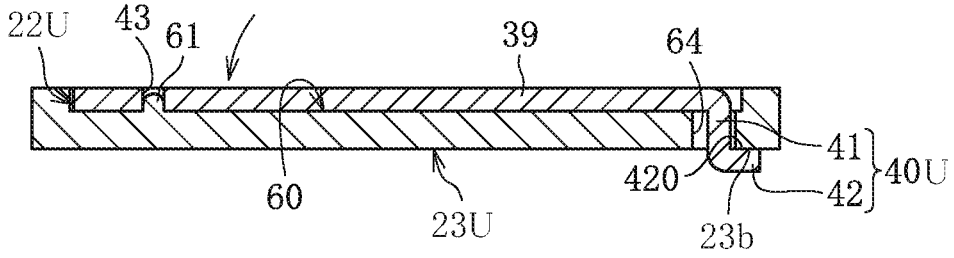
FIG. 22 is a cross-sectional view of the heater and the heater holder depicted in FIG. 20, illustrating another process of the method for attaching the heater to the heater holder.

As illustrated in FIG. 21, first, the bent portion 40U of the heater 22U is inserted into and engaged with the hole 64 disposed in the recess 60 of the heater holder 23U. The heater 22U pivots about an engagement point where the bent portion 40U engages the hole 64 in a pivot direction indicated with an arrow in FIG. 22. Accordingly, the recess 60 of the heater holder 23U accommodates the heater 22U and the projection 61 of the heater holder 23U is inserted into the positioning hole 43 of the heater 22U. Similarly to the embodiments described above, the connector 70 is attached to one end of the heater 22U where the electrodes 35 are disposed.

As described above, while the heater holder 23U holds the heater 22U, the bent portion 40U of the heater 22U is inserted into the hole 64 of the heater holder 23U. A tip of the bent portion 40U engages the back face 23*b* of the heater holder 23U, which is directed in the direction opposite the separating direction A. Accordingly, motion of the heater 22U with respect to the heater holder 23U in the separating direction A is restricted. For example, according to this embodiment, among faces of the bent portion 40U of the heater 22U, the front face 420 of the secondary bent portion 42 depicted in FIGS. 20 and 22, which is directed in the separating direction A, engages the back face 23*b* of the heater holder 23U, which serves as an engaged portion and is directed in the direction opposite the separating direction A. Accordingly, the front face 420 serves as a separation restrictor that restricts motion of the heater 22U with respect to the heater holder 23U in the separating direction A.

According to this embodiment also, like the embodiments described above, the primary bent portion 41 of the heater 22U is bent from the tab 39*b* mounted on the body 39 toward the heater holder 23U, not toward the fixing belt 20 and the fixing nip N. That is, the primary bent portion 41 is bent in the direction opposite the direction directed to the fixing belt 20 and the fixing nip N. Hence, the bent portion 40U does not interfere with the fixing belt 20 easily, facilitating installation of the heater 22U. Additionally, according to this embodiment, since the bent portion 40U is downsized, the thermal capacity of the base 30 decreases, saving energy.

Figure 23:
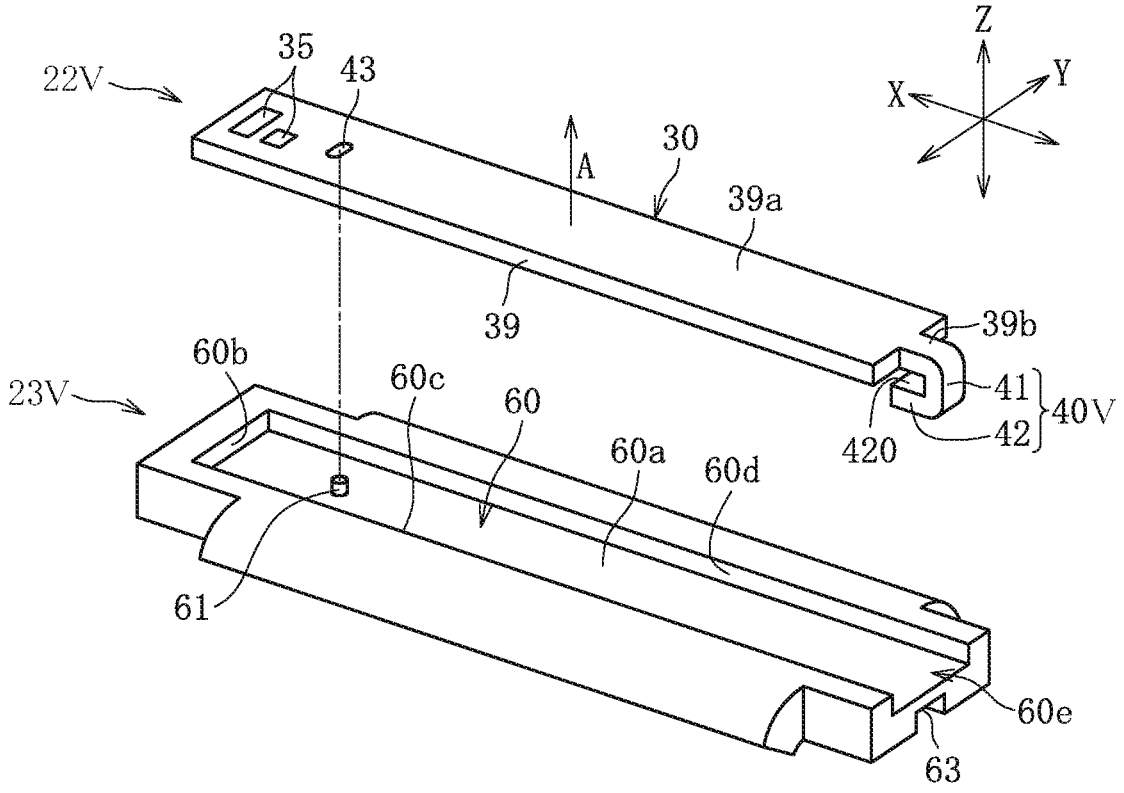
FIG. 23 is a perspective view of a heater and a heater holder according to a fifth embodiment of the present disclosure, that are installable in the fixing device depicted in FIG. 2.

FIG. 23 is a perspective view of a heater 22V and a heater holder 23V according to a fifth embodiment of the present disclosure.

According to the fifth embodiment illustrated in FIG. 23, like the fourth embodiment described above with reference to FIGS. 20 to 22, the heater 22V includes the body 39 mounting the tab 39*b*. The tab 39*b* projects from the body 39 in the longitudinal direction and mounts a bent portion 40V that includes the primary bent portion 41 and the secondary bent portion 42. However, unlike the secondary bent portion 42 according to the fourth embodiment, the secondary bent portion 42 according to the fifth embodiment is bent from the primary bent portion 41 toward the electrodes 35 mounted on the body 39. The heater holder 23V includes the hole 63 that is disposed on an end portion of an aperture side end where the longitudinal direction aperture 60*e* is disposed. The hole 63 is depressed in the longitudinal direction toward another end of the heater holder 23V, which is opposite the aperture side end, and in the thickness direction, that is, the separating direction A.

A description is provided of a method for attaching the heater 22V to the heater holder 23V according to the fifth embodiment.

Figure 24:
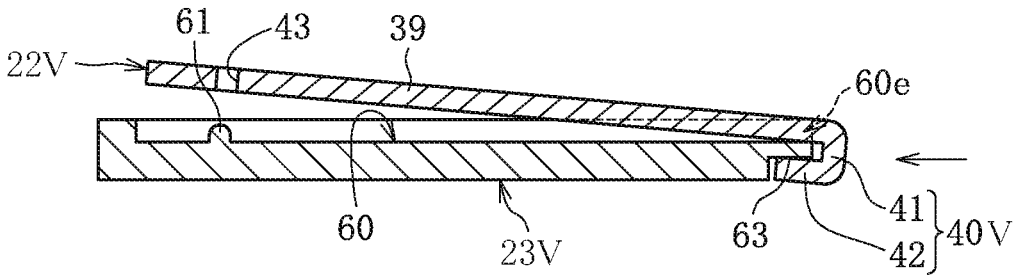
FIG. 24 is a cross-sectional view of the heater and the heater holder depicted in FIG. 23, illustrating a process of a method for attaching the heater to the heater holder.
Figure 25:
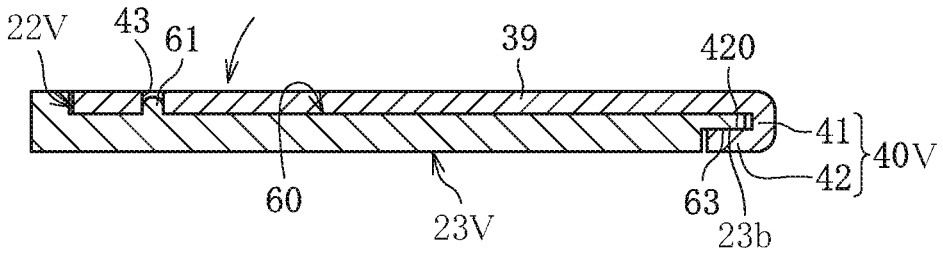
FIG. 25 is a cross-sectional view of the heater and the heater holder depicted in FIG. 23, illustrating another process of the method for attaching the heater to the heater holder.

As illustrated in FIG. 24, first, the bent portion 40V of the heater 22V is inserted into and engaged with the hole 63 of the heater holder 23V. The heater 22V pivots about an engagement point where the bent portion 40V engages the hole 63 in a pivot direction indicated with an arrow in FIG. 25. Accordingly, the recess 60 of the heater holder 23V accommodates the heater 22V and the projection 61 of the heater holder 23V is inserted into the positioning hole 43 of the heater 22V. Similarly to the embodiments described above, the connector 70 is attached to one end of the heater 22V where the electrodes 35 are disposed.

As described above, while the heater holder 23V holds the heater 22V, as the bent portion 40V of the heater 22V is inserted into the hole 63 of the heater holder 23V and a tip of the bent portion 40V engages the hole 63, motion of the heater 22V with respect to the heater holder 23V in the separating direction A is restricted. For example, according to this embodiment, among faces of the bent portion 40V of the heater 22V, the front face 420 of the secondary bent portion 42 depicted in FIGS. 23 and 25, which is directed in the separating direction A, engages the back face 23*b* which serves as an engaged portion, defines the hole 63, and is directed in the direction opposite the separating direction A. Accordingly, the front face 420 serves as a separation restrictor that restricts motion of the heater 22V with respect to the heater holder 23V in the separating direction A.

According to this embodiment also, like the embodiments described above, the primary bent portion 41 of the heater 22V is bent from the tab 39*b* mounted on the body 39 toward the heater holder 23V, not toward the fixing belt 20 and the fixing nip N. That is, the primary bent portion 41 is bent in the direction opposite the direction directed to the fixing belt 20 and the fixing nip N. Hence, the bent portion 40V does not interfere with the fixing belt 20 easily, facilitating installation of the heater 22V. Additionally, according to this embodiment, since the bent portion 40V is downsized, the thermal capacity of the base 30 decreases, saving energy.

Figure 26:
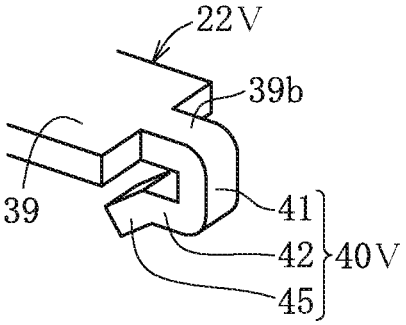
FIG. 26 is a cross-sectional view of the heater and the heater holder depicted in FIG. 25 as a modification example.

Alternatively, like a modification example illustrated in FIG. 26, the secondary bent portion 42 may mount a tertiary bent portion 45 that bends in a direction perpendicular to the secondary bent portion 42. The tertiary bent portion 45 is tilted such that a tip of the tertiary bent portion 45 separates from the body 39. Accordingly, the tertiary bent portion 45 serves as a guide that guides the bent portion 40V to the hole 63 as the bent portion 40V is inserted into the hole 63, facilitating insertion of the bent portion 40V into the hole 63.

Figure 27:
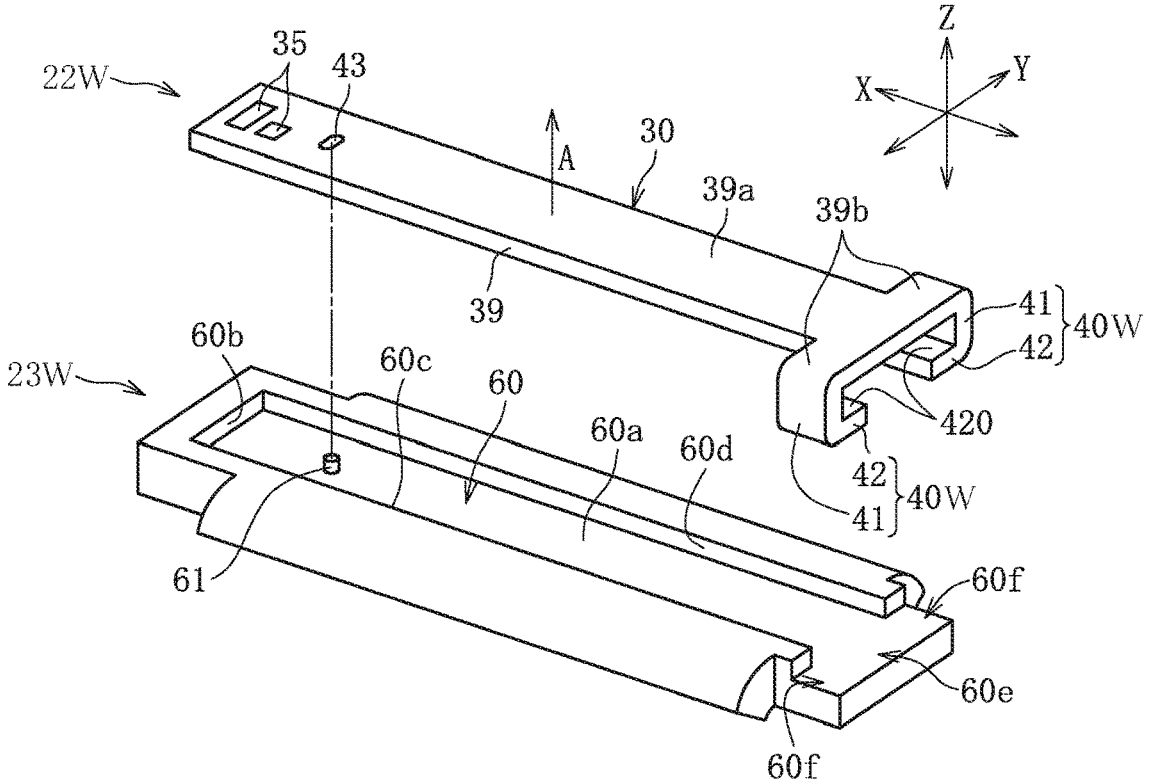
FIG. 27 is a perspective view of a heater and a heater holder according to a sixth embodiment of the present disclosure, that are installable in the fixing device depicted in FIG. 2.

FIG. 27 is a perspective view of a heater 22W and a heater holder 23W according to a sixth embodiment of the present disclosure.

The heater 22W according to the sixth embodiment illustrated in FIG. 27 includes the body 39 mounting the pair of tabs 39*b* disposed at one end of the body 39 in the longitudinal direction. The tabs 39*b* define an identical plane with the body 39 and project in the short direction from both ends of the body 39 in the short direction, respectively. Each of the tabs 39*b* mounts a bent portion 40W including the primary bent portion 41 and the secondary bent portion 42. The primary bent portion 41 is bent from the tab 39*b* in the direction opposite the separating direction A in which the heater 22W separates from the heater holder 23W. The secondary bent portion 42 is bent from the primary bent portion 41 inward in the short direction. In order to prevent the heater holder 23W from interfering with the pair of tabs 39*b* of the heater 22W, a part of each of the side faces 60*c* and 60*d* as the elongated side portions that define the recess 60 is cut out to produce the short direction aperture 60*f*. The short direction apertures 60*f* abut on the longitudinal direction aperture 60*e*. Each of the short direction apertures 60*f* opens to produce a space extending in the short direction.

A description is provided of a method for attaching the heater 22W to the heater holder 23W according to the sixth embodiment.

Figure 28:
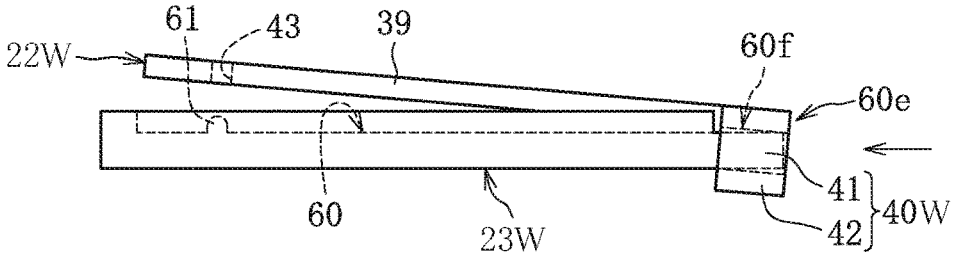
FIG. 28 is a cross-sectional view of the heater and the heater holder depicted in FIG. 27, illustrating a process of a method for attaching the heater to the heater holder.

As illustrated in FIG. 28, first, each of the bent portions 40W of the heater 22W, which is constructed of the primary bent portion 41 and the secondary bent portion 42, engages a vicinity of the short direction aperture 60*f* of the heater holder 23W. The heater 22W pivots about an engagement point where the bent portion 40W engages the vicinity of the short direction aperture 60*f* in a pivot direction indicated with an arrow in FIG. 29. Accordingly, the recess 60 of the heater holder 23W accommodates the heater 22W and the projection 61 of the heater holder 23W is inserted into the positioning hole 43 of the heater 22W. Similarly to the embodiments described above, the connector 70 is attached to one end of the heater 22W where the electrodes 35 are disposed.

Figure 29:
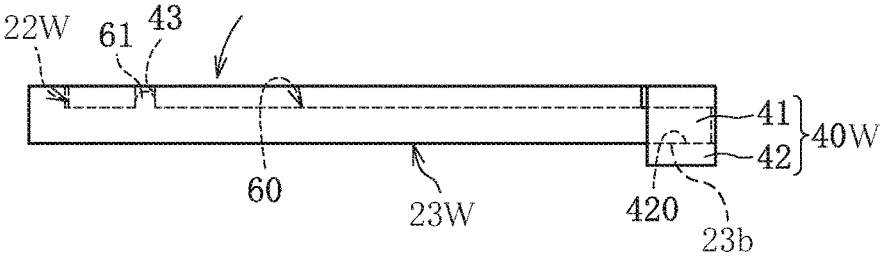
FIG. 29 is a cross-sectional view of the heater and the heater holder depicted in FIG. 27, illustrating another process of the method for attaching the heater to the heater holder.

As described above, while the heater holder 23W holds the heater 22W, as a tip of each of the bent portions 40W of the heater 22W engages the back face 23*b* of the heater holder 23W, which is directed in the direction opposite the separating direction A, at the vicinity of the short direction aperture 60*f*, motion of the heater 22W with respect to the heater holder 23W in the separating direction A is restricted. For example, according to this embodiment, among faces of each of the bent portions 40W of the heater 22W, the front face 420 of the secondary bent portion 42, which is directed in the separating direction A, as illustrated in FIGS. 27 and 29, engages the back face 23*b* of the heater holder 23W, which serves as an engaged portion and is directed in the direction opposite the separating direction A. Accordingly, the front face 420 serves as a separation restrictor that restricts motion of the heater 22W with respect to the heater holder 23W in the separating direction A.

According to this embodiment also, like the embodiments described above, each of the primary bent portions 41 of the heater 22W is bent from the tab 39*b* mounted on the body 39 toward the heater holder 23W, not toward the fixing belt 20 and the fixing nip N. That is, the primary bent portions 41 are bent in the direction opposite the direction directed to the fixing belt 20 and the fixing nip N. Hence, the bent portions 40W do not interfere with the fixing belt 20 easily, facilitating installation of the heater 22W. According to this embodiment, the bent portions 40W are disposed outboard from the body 39 in the short direction. Accordingly, the heater 22W is upsized in the short direction. However, the heater 22W is downsized in the longitudinal direction.

Figure 30:
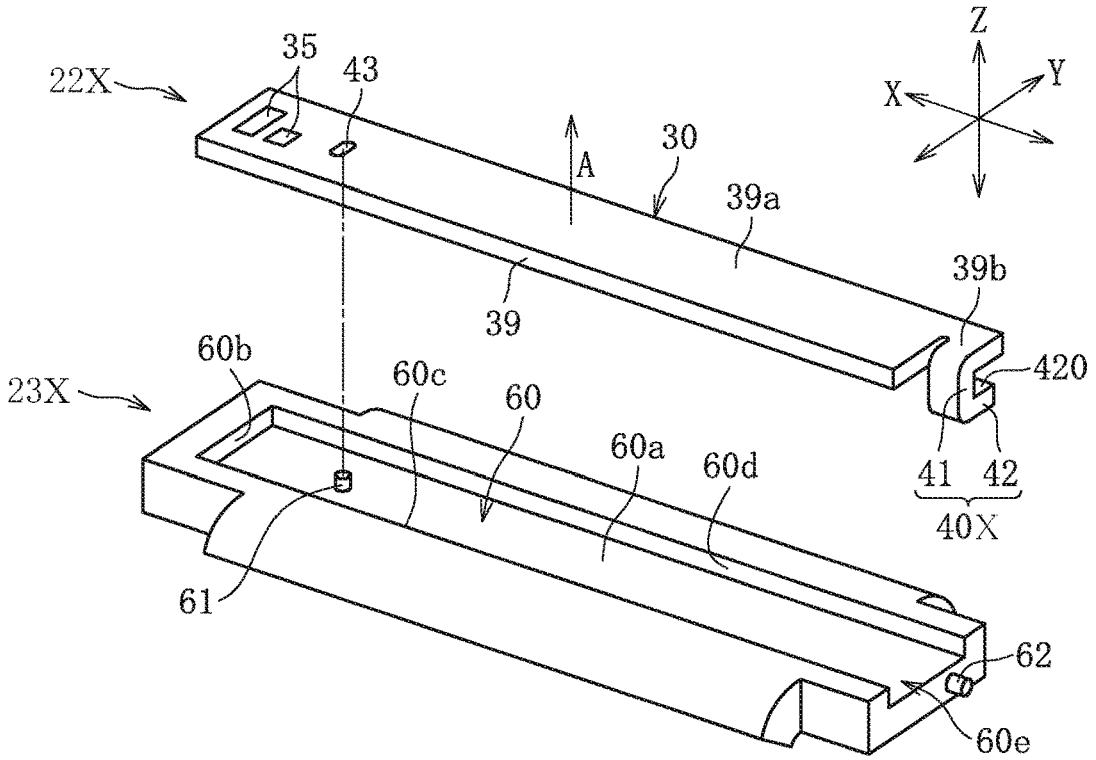
FIG. 30 is a perspective view of a heater and a heater holder according to a seventh embodiment of the present disclosure, that are installable in the fixing device depicted in FIG. 2.

FIG. 30 is a perspective view of a heater 22X and a heater holder 23X according to a seventh embodiment of the present disclosure.

The heater 22X according to the seventh embodiment illustrated in FIG. 30 includes the body 39 mounting the tab 39*b* projecting from one end of the body 39 in the longitudinal direction. The tab 39*b* defines an identical plane with the body 39 and projects in the longitudinal direction from one end of the body 39 in the longitudinal direction. The tab 39*b* mounts a bent portion 40X including the primary bent portion 41 and the secondary bent portion 42. The primary bent portion 41 is bent from the tab 39*b* in the direction opposite the separating direction A in which the heater 22X separates from the heater holder 23X. The secondary bent portion 42 is bent from the primary bent portion 41 in the short direction. The heater holder 23X includes the projection 62 that projects in the longitudinal direction. The projection 62 is disposed on an end portion of an aperture side end of the heater holder 23X, which abuts on the longitudinal direction aperture 60*e*.

A description is provided of a method for attaching the heater 22X to the heater holder 23X according to the seventh embodiment.

Figure 31:
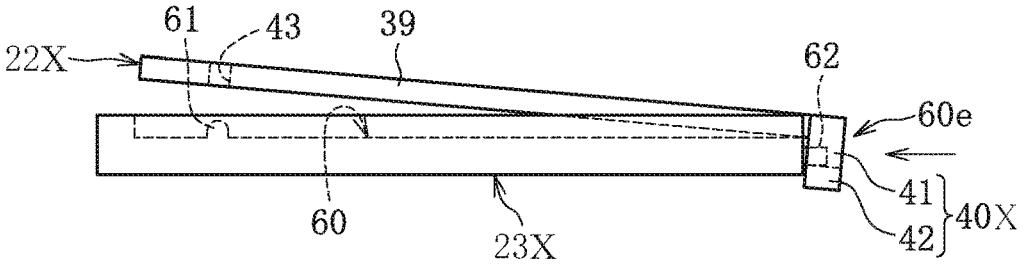
FIG. 31 is a cross-sectional view of the heater and the heater holder depicted in FIG. 30, illustrating a process of a method for attaching the heater to the heater holder.

As illustrated in FIG. 31, first, the bent portion 40X of the heater 22X engages the projection 62 of the heater holder 23X. The heater 22X pivots about an engagement point where the bent portion 40X engages the projection 62 in a pivot direction indicated with an arrow in FIG. 32. Accordingly, the recess 60 of the heater holder 23X accommodates the heater 22X and the projection 61 of the heater holder 23X is inserted into the positioning hole 43 of the heater 22X. Similarly to the embodiments described above, the connector 70 is attached to one end of the heater 22X where the electrodes 35 are disposed.

Figure 32:
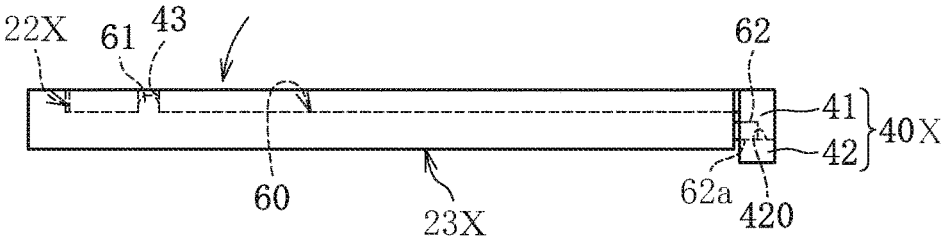
FIG. 32 is a cross-sectional view of the heater and the heater holder depicted in FIG. 30, illustrating another process of the method for attaching the heater to the heater holder.

As described above, while the heater holder 23X holds the heater 22X, as the bent portion 40X of the heater 22X engages the projection 62 of the heater holder 23X, motion of the heater 22X with respect to the heater holder 23X in the separating direction A is restricted. For example, according to this embodiment, among faces of the bent portion 40X of the heater 22X, the front face 420 of the secondary bent portion 42, which is directed in the separating direction A, as illustrated in FIGS. 30 and 32, engages the back face 62*a* of the projection 62, which serves as an engaged portion or an engaged face and is directed in the direction opposite the separating direction A. Accordingly, the front face 420 serves as a separation restrictor that restricts motion of the heater 22X with respect to the heater holder 23X in the separating direction A.

According to this embodiment also, like the embodiments described above, the primary bent portion 41 of the heater 22X is bent from the tab 39*b* mounted on the body 39 toward the heater holder 23X, not toward the fixing belt 20 and the fixing nip N. That is, the primary bent portion 41 is bent in the direction opposite the direction directed to the fixing belt 20 and the fixing nip N. Hence, the bent portion 40X does not interfere with the fixing belt 20 easily, facilitating installation of the heater 22X. Additionally, according to this embodiment, since the bent portion 40X is downsized, the thermal capacity of the base 30 decreases, saving energy.

Figure 33:
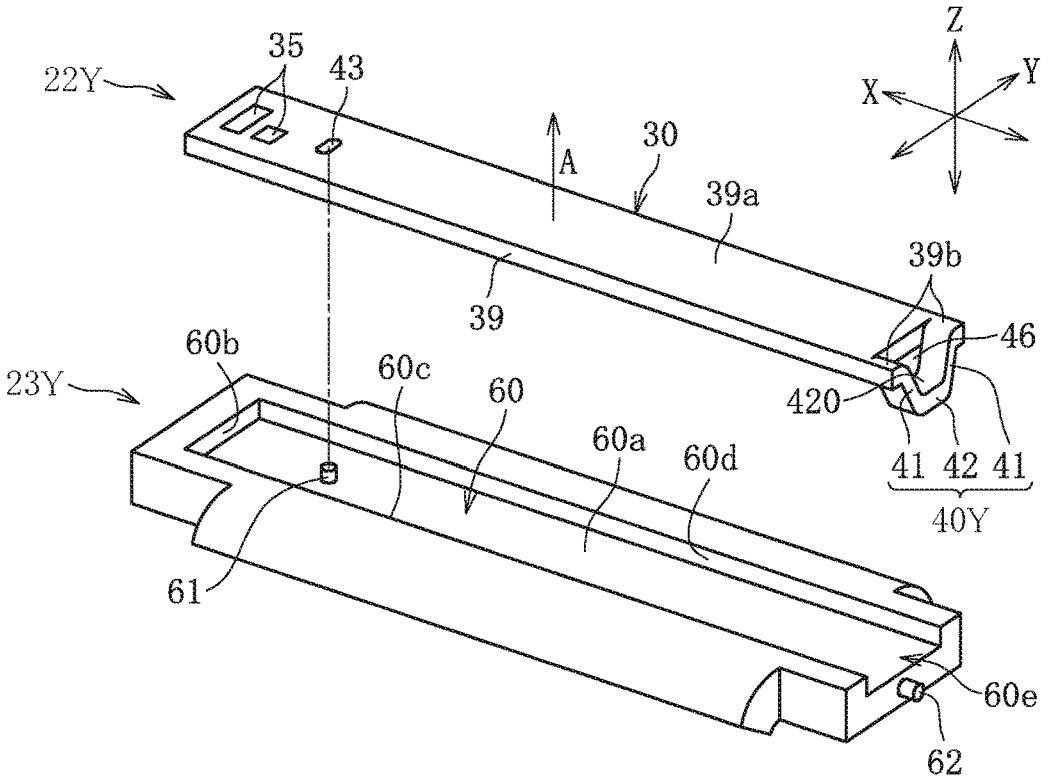
FIG. 33 is a perspective view of a heater and a heater holder according to an eighth embodiment of the present disclosure, that are installable in the fixing device depicted in FIG. 2.

FIG. 33 is a perspective view of a heater 22Y and a heater holder 23Y according to an eighth embodiment of the present disclosure.

The heater 22Y according to the eighth embodiment illustrated in FIG. 33 includes the body 39 mounting the pair of tabs 39*b* disposed at one end of the body 39 in the longitudinal direction. The tabs 39*b* define an identical plane with the body 39 and project in the longitudinal direction from both ends of the body 39 in the short direction, respectively. Each of the tabs 39*b* mounts a bent portion 40Y including a pair of primary bent portions 41 and the secondary bent portion 42. The primary bent portion 41 is bent from the tab 39*b* in the direction opposite the separating direction A in which the heater 22Y separates from the heater holder 23Y. The secondary bent portion 42 is bent in the short direction from each of the primary bent portions 41 and bridges the primary bent portions 41. For example, according to this embodiment, the pair of primary bent portions 41 and the secondary bent portion 42 that bridges the primary bent portions 41 construct the bent portion 40Y having a concave shape. The bent portion 40Y having the concave shape and an edge face of the body 39 define a hole 46. The heater holder 23Y includes the projection 62 that projects in the longitudinal direction. The projection 62 is disposed on an end portion of an aperture side end of the heater holder 23Y, which abuts on the longitudinal direction aperture 60*e*.

A description is provided of a method for attaching the heater 22Y to the heater holder 23Y according to the eighth embodiment.

Figure 34:
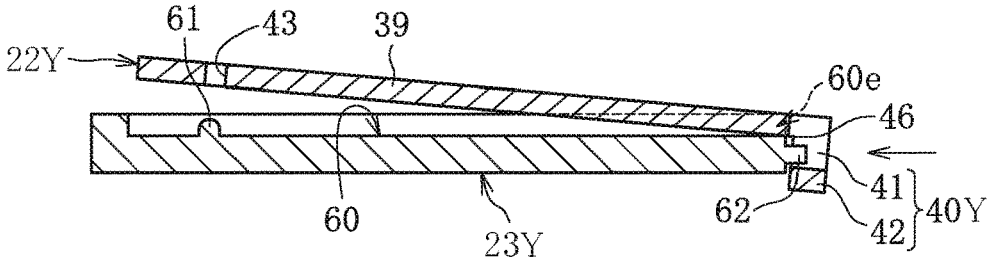
FIG. 34 is a cross-sectional view of the heater and the heater holder depicted in FIG. 33, illustrating a process of a method for attaching the heater to the heater holder.

As illustrated in FIG. 34, first, the projection 62 of the heater holder 23Y is inserted into the hole 46 produced between the bent portion 40Y and the body 39 of the heater 22Y. An edge of the bent portion 40Y or the hole 46 engages the projection 62. The heater 22Y pivots about an engagement point where the edge of the bent portion 40Y or the hole 46 engages the projection 62 in a pivot direction indicated with an arrow in FIG. 35. Accordingly, the recess 60 of the heater holder 23Y accommodates the heater 22Y and the projection 61 of the heater holder 23Y is inserted into the positioning hole 43 of the heater 22Y. Similarly to the embodiments described above, the connector 70 is attached to one end of the heater 22Y where the electrodes 35 are disposed.

Figure 35:
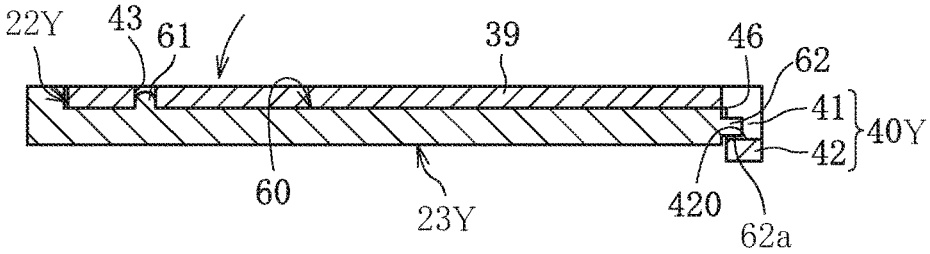
FIG. 35 is a cross-sectional view of the heater and the heater holder depicted in FIG. 33, illustrating another process of the method for attaching the heater to the heater holder.

As described above, while the heater holder 23Y holds the heater 22Y, as the bent portion 40Y of the heater 22Y engages the projection 62 of the heater holder 23Y, motion of the heater 22Y with respect to the heater holder 23Y in the separating direction A is restricted. For example, according to this embodiment, among faces of the bent portion 40Y of the heater 22Y, the front face 420 of the secondary bent portion 42, which is directed in the separating direction A as illustrated in FIGS. 33 and 35, engages the back face 62*a* of the projection 62, which serves as an engaged portion or an engaged face and is directed in the direction opposite the separating direction A. Accordingly, the front face 420 serves as a separation restrictor that restricts motion of the heater 22Y with respect to the heater holder 23Y in the separating direction A.

According to this embodiment also, like the embodiments described above, each of the primary bent portions 41 of the heater 22Y is bent from the tab 39*b* mounted on the body 39 toward the heater holder 23Y, not toward the fixing belt 20 and the fixing nip N. That is, each of the primary bent portions 41 is bent in the direction opposite the direction directed to the fixing belt 20 and the fixing nip N. Hence, the bent portion 40Y does not interfere with the fixing belt 20 easily, facilitating installation of the heater 22Y.

Figure 36:
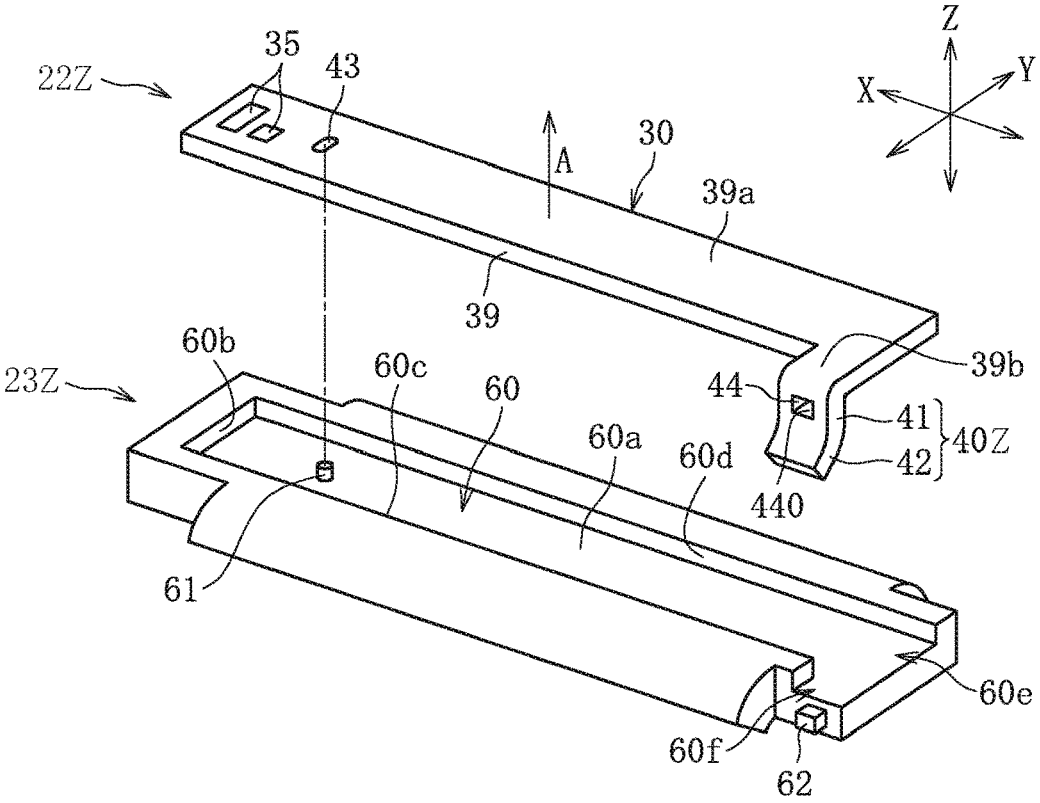
FIG. 36 is a perspective view of a heater and a heater holder according to a ninth embodiment of the present disclosure, that are installable in the fixing device depicted in FIG. 2.

FIG. 36 is a perspective view of a heater 22Z and a heater holder 23Z according to a ninth embodiment of the present disclosure.

The heater 22Z according to the ninth embodiment illustrated in FIG. 36 includes the body 39 mounting the tab 39*b* disposed at one end of the body 39 in the longitudinal direction. The tab 39*b* defines an identical plane with the body 39 and projects in the short direction from one end of the body 39 in the short direction. The tab 39*b* mounts a bent portion 40Z including the primary bent portion 41 and the secondary bent portion 42. The primary bent portion 41 is bent from the tab 39*b* in the direction opposite the separating direction A in which the heater 22Z separates from the heater holder 23Z. The secondary bent portion 42 is bent from the primary bent portion 41 outward in the short direction. Additionally, the hole 44 is disposed in the primary bent portion 41. The heater holder 23Z includes the projection 62 that projects in the short direction. The projection 62 is disposed on a side end portion of an aperture side end of the heater holder 23Z, which abuts on the longitudinal direction aperture 60*e*. In order to prevent the heater holder 23Z from interfering with the tab 39*b* mounted on the body 39 of the heater 22Z, the heater holder 23Z includes the short direction aperture 60*f* that opens to produce a space extending in the short direction and abuts on the longitudinal direction aperture 60*e*. A part of the side face 60*c* as one of the elongated side portions that define the recess 60 is cut out to produce the short direction aperture 60*f*.

A description is provided of a method for attaching the heater 22Z to the heater holder 23Z according to the ninth embodiment.

Figure 37:
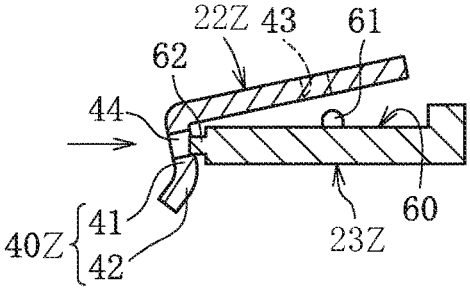
FIG. 37 is a cross-sectional view of the heater and the heater holder depicted in FIG. 36, illustrating a process of a method for attaching the heater to the heater holder.

According to the ninth embodiment, the heater 22Z is moved closer to the heater holder 23Z to engage the heater holder 23Z in a direction different from the direction defined in the embodiments described above. For example, as illustrated in FIG. 37 that illustrates the heater 22Z and the heater holder 23Z seen from a right side in FIG. 36, first, the heater 22Z is moved closer to the heater holder 23Z in the short direction. The projection 62 of the heater holder 23Z is inserted into and engaged with the hole 44 disposed in the primary bent portion 41. The heater 22Z pivots about an engagement point where the hole 44 engages the projection 62 in a pivot direction indicated with an arrow in FIG. 38. Accordingly, the recess 60 of the heater holder 23Z accommodates the heater 22Z and the projection 61 of the heater holder 23Z is inserted into the positioning hole 43 of the heater 22Z. Similarly to the embodiments described above, the connector 70 is attached to one end of the heater 22Z where the electrodes 35 are disposed.

Figure 38:
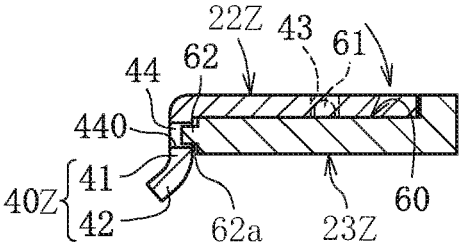
FIG. 38 is a cross-sectional view of the heater and the heater holder depicted in FIG. 36, illustrating another process of the method for attaching the heater to the heater holder.

As described above, while the heater holder 23Z holds the heater 22Z, as the hole 44 of the heater 22Z engages the projection 62 of the heater holder 23Z, motion of the heater 22Z with respect to the heater holder 23Z in the separating direction A is restricted. For example, according to this embodiment, among faces that construct the hole 44 of the heater 22Z, the front face 440 of the hole 44, which is directed in the separating direction A as illustrated in FIGS. 36 and 38, engages the back face 62*a* of the projection 62, which serves as an engaged portion or an engaged face and is directed in the direction opposite the separating direction A. Accordingly, the front face 440 serves as a separation restrictor that restricts motion of the heater 22Z with respect to the heater holder 23Z in the separating direction A. Alternatively, in contrast to this embodiment, a projection may be disposed on the primary bent portion 41 and a hole that engages the projection may be disposed in the heater holder 23Z. Alternatively, the hole 44 of the heater 22Z or the hole of the heater holder 23Z may be a hole having a bottom, instead of a through hole.

Figure 39:
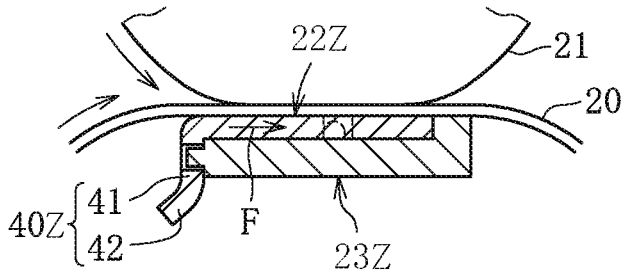
FIG. 39 is a cross-sectional view of the heater and the heater holder depicted in FIG. 36, illustrating the heater positioned by a bias received from a fixing belt incorporated in the fixing device depicted in FIG. 2 and directed in a rotation direction of the fixing belt.

Additionally, according to this embodiment, as illustrated in FIG. 39, the bent portion 40Z of the heater 22Z is preferably disposed upstream from the heater holder 23Z in the rotation direction of the fixing belt 20. Accordingly, as the heater 22Z receives a bias F directed in the rotation direction of the fixing belt 20 from the fixing belt 20, the primary bent portion 41 of the heater 22Z is brought into contact with the heater holder 23Z by the bias F. Thus, the heater 22Z is positioned with respect to the heater holder 23Z in the short direction.

According to this embodiment also, like the embodiments described above, the primary bent portion 41 of the heater 22Z is bent from the tab 39*b* mounted on the body 39 toward the heater holder 23Z, not toward the fixing belt 20 and the fixing nip N. That is, the primary bent portion 41 is bent in the direction opposite the direction directed to the fixing belt 20 and the fixing nip N. Hence, the bent portion 40Z does not interfere with the fixing belt 20 easily, facilitating installation of the heater 22Z. According to this embodiment, the bent portion 40Z is disposed outboard from the body 39 in the short direction. Accordingly, the heater 22Z is upsized in the short direction. However, the heater 22Z is downsized in the longitudinal direction. Additionally, according to this embodiment, since the bent portion 40Z is downsized, the thermal capacity of the base 30 decreases, saving energy.

Figure 40:
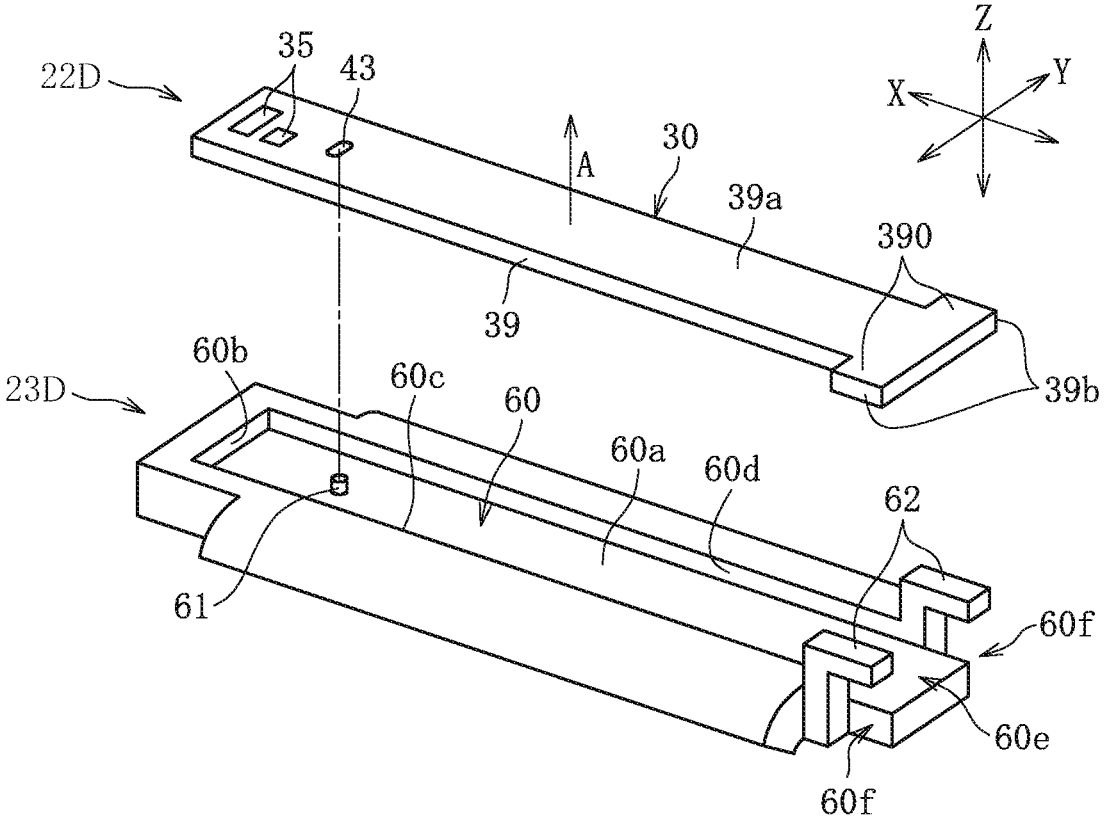
FIG. 40 is a perspective view of a heater and a heater holder according to a tenth embodiment of the present disclosure, that are installable in the fixing device depicted in FIG. 2.

FIG. 40 is a perspective view of a heater 22D and a heater holder 23D according to a tenth embodiment of the present disclosure.

The heater 22D according to the tenth embodiment illustrated in FIG. 40 includes the body 39 mounting the pair of tabs 39*b* disposed at one end of the body 39 in the longitudinal direction. The tabs 39*b* define an identical plane with the body 39 and project in the short direction from both ends of the body 39 in the short direction, respectively. According to this embodiment, the heater 22D does not incorporate the bent portion 40. The heater holder 23D includes the pair of projections 62 that projects in the separating direction A in which the heater 22D separates from the heater holder 23D. The projections 62 project from one end of the side faces 60*c* and 60*d*, that is, the elongated side portions that define the recess 60, respectively, in the longitudinal direction. Each of the projections 62 is bent further in the longitudinal direction. In order to prevent the heater holder 23D from interfering with the tabs 39*b* of the heater 22D, the heater holder 23D includes the pair of short direction apertures 60*f* that opens to produce a space extending in the short direction and abuts on the projections 62, respectively. A part of each of the side faces 60*c* and 60*d*, that is, the elongated side portions that define the recess 60, respectively, is cut out to produce the short direction aperture 60*f*.

A description is provided of a method for attaching the heater 22D to the heater holder 23D according to the tenth embodiment.

Figure 41:
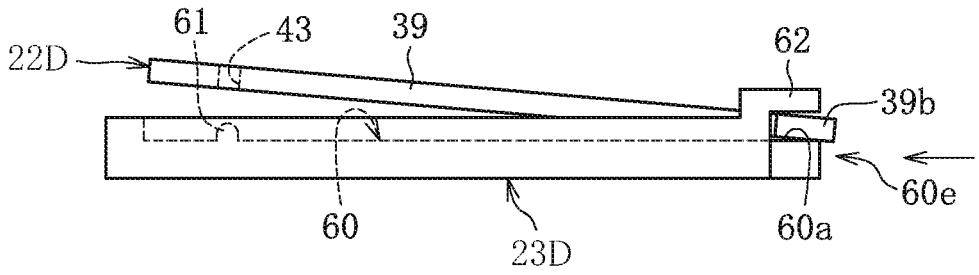
FIG. 41 is a cross-sectional view of the heater and the heater holder depicted in FIG. 40, illustrating a process of a method for attaching the heater to the heater holder.

As illustrated in FIG. 41, first, each of the tabs 39*b* of the heater 22D is inserted into a gap between the projection 62 and the bottom face 60*a* of the heater holder 23D and engaged with the projection 62. The heater 22D pivots about an engagement point where the tab 39*b* engages the projection 62 in a pivot direction indicated with an arrow in FIG. 42. Accordingly, the recess 60 of the heater holder 23D accommodates the heater 22D and the projection 61 of the heater holder 23D is inserted into the positioning hole 43 of the heater 22D. Similarly to the embodiments described above, the connector 70 is attached to one end of the heater 22D where the electrodes 35 are disposed.

Figure 42:
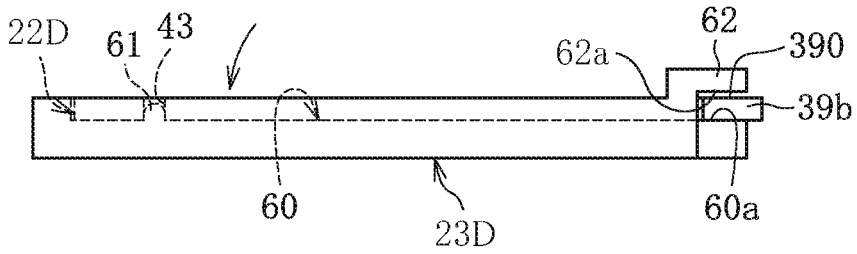
FIG. 42 is a cross-sectional view of the heater and the heater holder depicted in FIG. 40, illustrating another process of the method for attaching the heater to the heater holder.

As described above, while the heater holder 23D holds the heater 22D, as the tabs 39*b* of the heater 22D engage the projections 62 of the heater holder 23D, respectively, motion of the heater 22D with respect to the heater holder 23D in the separating direction A is restricted. For example, according to this embodiment, each of the tabs 39*b* of the heater 22D includes a front face 390 directed in the separating direction A as illustrated in FIGS. 40 and 42. The front face 390 engages the back face 62*a* of the projection 62 of the heater holder 23D, which serves as an engaged portion or an engaged face and is directed in the direction opposite the separating direction A. Accordingly, the front face 390 serves as a separation restrictor that restricts motion of the heater 22D with respect to the heater holder 23D in the separating direction A. Alternatively, a space (e.g., the short direction aperture 60*f*) between the projection 62 and the bottom face 60*a* of the heater holder 23D may define a hole that engages the tab 39*b* of the heater 22D.

Figure 43:
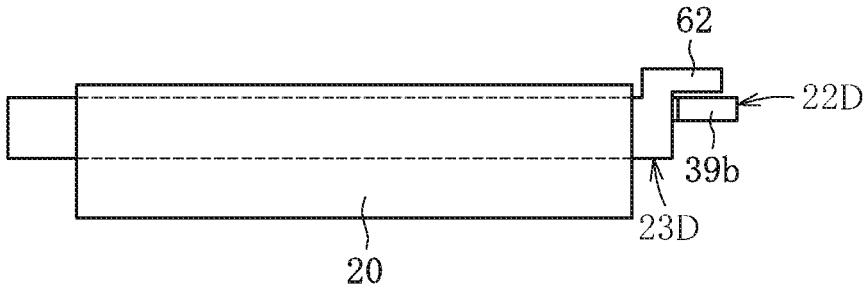
FIG. 43 is a side view of the heater and the heater holder depicted in FIG. 42, illustrating tabs incorporated in the heater and projections incorporated in the heater holder that are disposed outboard from a lateral end of the fixing belt.

The heater 22D according to this embodiment, which does not incorporate the bent portion 40, is not subject to processing of bending and is manufactured at reduced costs. On the other hand, according to this embodiment, the projections 62 of the heater holder 23D project in the separating direction A in which the heater 22D separates from the heater holder 23D. Accordingly, if the projections 62 are disposed inside the loop formed by the fixing belt 20, the projections 62 may interfere with the fixing belt 20. Hence, in order to prevent the projections 62 from interfering with the fixing belt 20, as illustrated in FIG. 43, the projections 62 and the tabs 39*b* are preferably disposed outboard from a lateral end of the fixing belt 20 in the width direction, that is, the axial direction, of the fixing belt 20.

Figure 44:
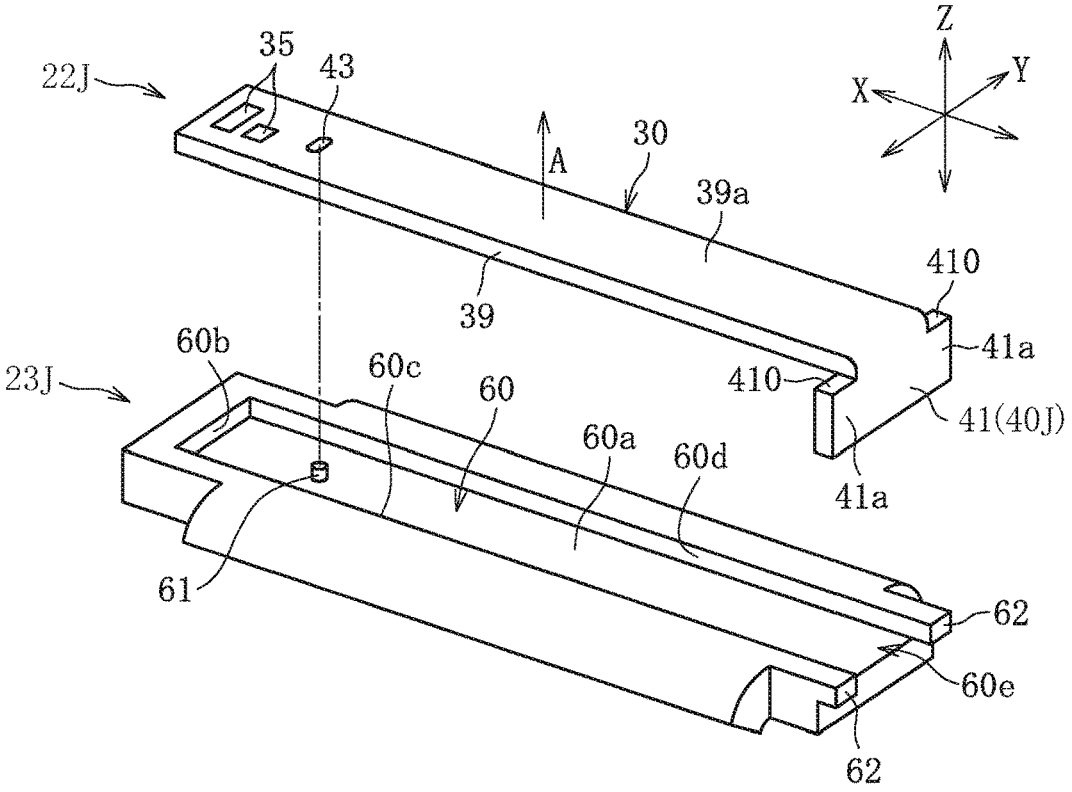
FIG. 44 is a perspective view of a heater and a heater holder according to an eleventh embodiment of the present disclosure, that are installable in the fixing device depicted in FIG. 2.

FIG. 44 is a perspective view of a heater 22J and a heater holder 23J according to an eleventh embodiment of the present disclosure.

As illustrated in FIG. 44, the heater 22J according to the eleventh embodiment includes a bent portion 40J mounted on one end of the body 39 in the longitudinal direction. The bent portion 40J includes the primary bent portion 41. The primary bent portion 41 is bent from one end of the body 39 in the direction opposite the separating direction A in which the heater 22J separates from the heater holder 23J. The primary bent portion 41 mounts a pair of tabs 41*a* that defines an identical plane with the primary bent portion 41. The tabs 41*a* project from both ends of the primary bent portion 41 in the short direction, respectively. The heater holder 23J includes the pair of projections 62 that projects in the longitudinal direction. Each of the projections 62 abuts on an end portion of an aperture side end of the heater holder 23J, which abuts on the longitudinal direction aperture 60*e*. The projections 62 project from one end of the side faces 60*c* and 60*d*, that is, the elongated side portions that define the recess 60, respectively, in the longitudinal direction.

A description is provided of a method for attaching the heater 22J to the heater holder 23J according to the eleventh embodiment.

Figure 45:
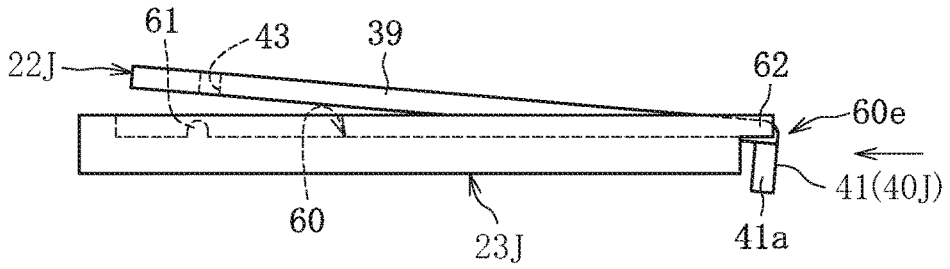
FIG. 45 is a cross-sectional view of the heater and the heater holder depicted in FIG. 44, illustrating a process of a method for attaching the heater to the heater holder.

As illustrated in FIG. 45, first, the tabs 41*a* mounted on the primary bent portion 41 of the heater 22J engage the projections 62 of the heater holder 23J, respectively. The heater 22J pivots about an engagement point where each of the tabs 41*a* engages the projection 62 in a pivot direction indicated with an arrow in FIG. 46. Accordingly, the recess 60 of the heater holder 23J accommodates the heater 22J and the projection 61 of the heater holder 23J is inserted into the positioning hole 43 of the heater 22J. Similarly to the embodiments described above, the connector 70 is attached to one end of the heater 22J where the electrodes 35 are disposed.

Figure 46:
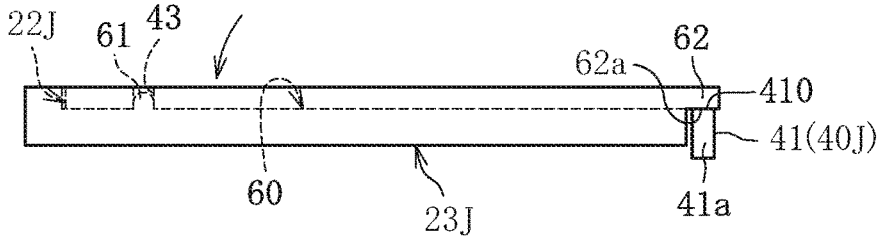
FIG. 46 is a cross-sectional view of the heater and the heater holder depicted in FIG. 44, illustrating another process of the method for attaching the heater to the heater holder.

As described above, while the heater holder 23J holds the heater 22J, as the tabs 41*a* mounted on the primary bent portion 41 of the heater 22J engage the projections 62 of the heater holder 23J, respectively, motion of the heater 22J with respect to the heater holder 23J in the separating direction A is restricted. For example, according to this embodiment, among faces that construct the tab 41*a* mounted on the primary bent portion 41 of the heater 22J, a front face 410, serving a separating direction face, of the tab 41*a*, which is directed in the separating direction A as illustrated in FIGS. 44 and 46, engages the back face 62*a* of the projection 62 of the heater holder 23J, which serves as an engaged portion or an engaged face and is directed in the direction opposite the separating direction A. Accordingly, the front face 410 serves as a separation restrictor that restricts motion of the heater 22J with respect to the heater holder 23J in the separating direction A.

According to this embodiment also, like the embodiments described above, the primary bent portion 41 of the heater 22J is bent from the body 39 toward the heater holder 23J, not toward the fixing belt 20 and the fixing nip N. That is, the primary bent portion 41 is bent in the direction opposite the direction directed to the fixing belt 20 and the fixing nip N. Hence, the bent portion 40J does not interfere with the fixing belt 20 easily, facilitating installation of the heater 22J. According to this embodiment, since the heater 22J does not incorporate the secondary bent portion 42, the heater 22J is manufactured readily with simple processing of bending the base 30 once.

Figure 47:
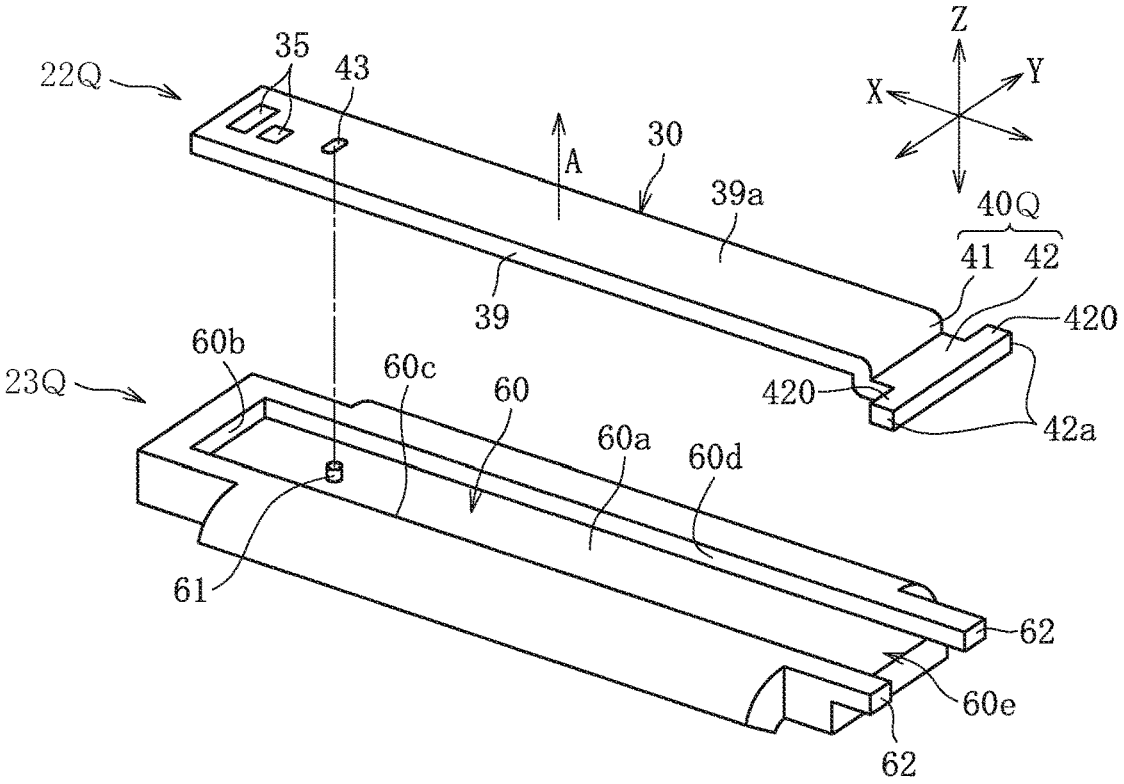
FIG. 47 is a perspective view of a heater and a heater holder according to a twelfth embodiment of the present disclosure, that are installable in the fixing device depicted in FIG. 2.

FIG. 47 is a perspective view of a heater 22Q and a heater holder 23Q according to a twelfth embodiment of the present disclosure.

As illustrated in FIG. 47, the heater 22Q according to the twelfth embodiment includes a bent portion 40Q including the primary bent portion 41 and the secondary bent portion 42. The primary bent portion 41 is mounted on one end of the body 39 in the longitudinal direction. The primary bent portion 41 is bent from one end of the body 39 in the direction opposite the separating direction A in which the heater 22Q separates from the heater holder 23Q. The secondary bent portion 42 is bent from the primary bent portion 41 in the longitudinal direction. The secondary bent portion 42 defines an identical plane with a pair of tabs 42*a* that projects from both ends of the secondary bent portion 42 in the short direction, respectively. Like the heater holder 23J according to the eleventh embodiment depicted in FIGS. 44 to 46, the heater holder 23Q includes the pair of projections 62 that projects in the longitudinal direction. Each of the projections 62 abuts on an end portion of an aperture side end of the heater holder 23Q, which abuts on the longitudinal direction aperture 60*e*. The projections 62 project from one end of the side faces 60*c* and 60*d*, that is, the elongated side portions that define the recess 60, respectively, in the longitudinal direction.

A description is provided of a method for attaching the heater 22Q to the heater holder 23Q according to the twelfth embodiment.

Figure 48:
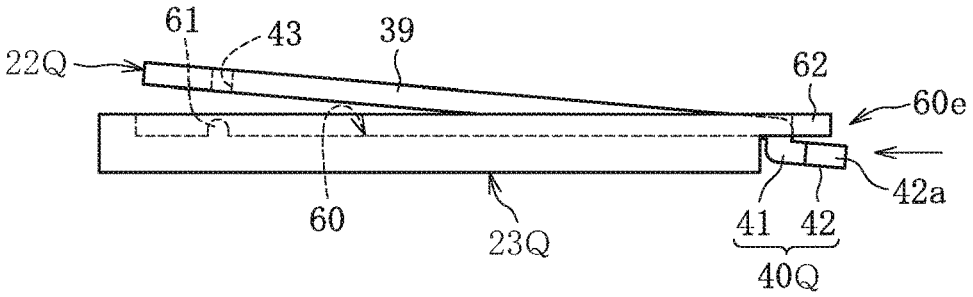
FIG. 48 is a cross-sectional view of the heater and the heater holder depicted in FIG. 47, illustrating a process of a method for attaching the heater to the heater holder.

As illustrated in FIG. 48, first, the tabs 42*a* mounted on the secondary bent portion 42 of the heater 22Q engage the projections 62 of the heater holder 23Q, respectively. The heater 22Q pivots about an engagement point where each of the tabs 42*a* engages the projection 62 in a pivot direction indicated with an arrow in FIG. 49. Accordingly, the recess 60 of the heater holder 23Q accommodates the heater 22Q and the projection 61 of the heater holder 23Q is inserted into the positioning hole 43 of the heater 22Q. Similarly to the embodiments described above, the connector 70 is attached to one end of the heater 22Q where the electrodes 35 are disposed.

Figure 49:
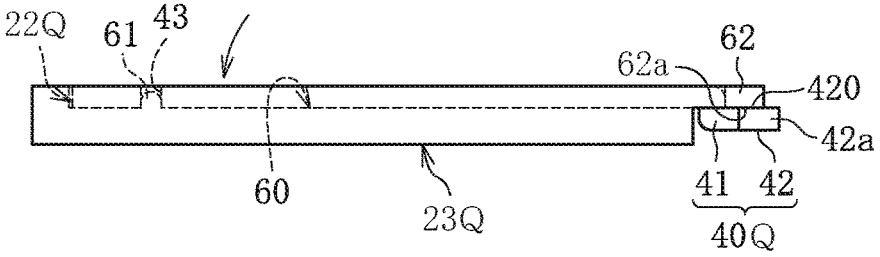
FIG. 49 is a cross-sectional view of the heater and the heater holder depicted in FIG. 47, illustrating another process of the method for attaching the heater to the heater holder.

As described above, while the heater holder 23Q holds the heater 22Q, as the tabs 42*a* mounted on the secondary bent portion 42 of the heater 22Q engage the projections 62 of the heater holder 23Q, respectively, motion of the heater 22Q with respect to the heater holder 23Q in the separating direction A is restricted. For example, according to this embodiment, among faces that construct each of the tabs 42*a* mounted on the secondary bent portion 42 of the heater 22Q, the front face 420 of the tab 42*a*, which is directed in the separating direction A as illustrated in FIGS. 47 and 49, engages the back face 62*a* of the projection 62 of the heater holder 23Q, which serves as an engaged portion or an engaged face and is directed in the direction opposite the separating direction A. Accordingly, the front face 420 serves as a separation restrictor that restricts motion of the heater 22Q with respect to the heater holder 23Q in the separating direction A.

According to this embodiment also, like the embodiments described above, the primary bent portion 41 of the heater 22Q is bent from the body 39 toward the heater holder 23Q, not toward the fixing belt 20 and the fixing nip N. That is, the primary bent portion 41 is bent in the direction opposite the direction directed to the fixing belt 20 and the fixing nip N. Hence, the bent portion 40Q does not interfere with the fixing belt 20 easily, facilitating installation of the heater 22Q.

Figure 50:
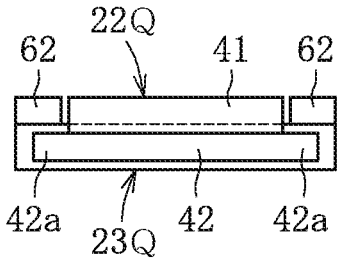
FIG. 50 is a lateral end view of the heater and the heater holder depicted in FIG. 49 seen from a longitudinal direction aperture of the heater holder, illustrating the heater attached to the heater holder.

FIG. 50 is a lateral end view of the heater 22Q and the heater holder 23Q according to this embodiment, seen from the longitudinal direction aperture 60*e* of the heater holder 23Q while the heater 22Q is attached to the heater holder 23Q.

Figure 51:
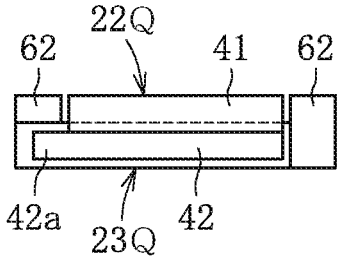
FIG. 51 is a lateral end view of the heater and the heater holder depicted in FIG. 50 as a modification example.
Figure 52:
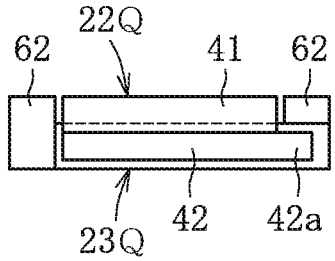
FIG. 52 is a lateral end view of the heater and the heater holder depicted in FIG. 50 as another modification example.

As illustrated in FIG. 50, according to this embodiment, the secondary bent portion 42 mounts the pair of tabs 42*a* that projects from both ends of the secondary bent portion 42 in the short direction, respectively. The tabs 42*a* of the heater 22Q engage the projections 62, respectively, preventing the heater 22Q from separating from the heater holder 23Q. Like modification examples illustrated in FIGS. 51 and 52, one of the pair of tabs 42*a* may be omitted. In this case also, the single tab 42*a* of the heater 22Q engages one of the projections 62 of the heater holder 23Q, preventing the heater 22Q from separating from the heater holder 23Q. Additionally, as illustrated in FIGS. 51 and 52, another one of the projections 62 of the heater holder 23Q, which does not engage the tab 42*a*, is elongated in the thickness direction. For example, when the heater 22Q configured to be applied with a different voltage is installed, faulty installation or the like is prevented. For example, if a service engineer attempts to attach the heater 22Q depicted in FIG. 51 to the heater holder 23Q depicted in FIG. 52 erroneously, the tab 42*a* interferes with the left projection 62 depicted in FIG. 52, inhibiting the service engineer from attaching the heater 22Q to the heater holder 23Q. Conversely, if the service engineer attempts to attach the heater 22Q depicted in FIG. 52 to the heater holder 23Q depicted in FIG. 51 erroneously, attachment of the heater 22Q to the heater holder 23Q is inhibited similarly. As described above, unless the tab 42*a* of the heater 22Q fits the projection 62 of the heater holder 23Q in shape, the heater 22Q is not attached to the heater holder 23Q, preventing erroneous attachment.

The above describes the embodiments of the present disclosure. However, the embodiments of the present disclosure may be modified variously within the scope of the present disclosure. For example, the embodiments and the modification examples thereof described above may be combined properly.

The embodiments are described above with the image forming apparatus 100 as a color image forming apparatus that forms a color toner image as an example. Alternatively, the image forming apparatus 100 according to the embodiments of the present disclosure may be a monochrome image forming apparatus that forms a monochrome toner image. The image forming apparatus 100 according to the embodiments of the present disclosure is a printer, a copier, a facsimile machine, a multifunction peripheral (MFP) having at least two of printing, copying, facsimile, scanning, and plotter functions, or the like.

Figure 53:
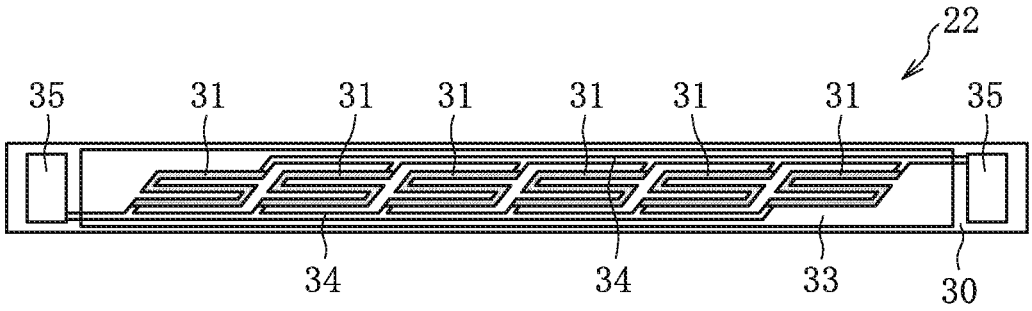
FIG. 53 is a plan view of the heater as a variation of the heater depicted in FIG. 3.

As illustrated in FIG. 3, according to the embodiments described above, the two resistive heat generators 31 are extended in the longitudinal direction of the base 30 and are parallel to each other. The two resistive heat generators 31 are electrically connected in series. Alternatively, like an example illustrated in FIG. 53, the heater 22 may include the plurality of resistive heat generators 31 arranged in the longitudinal direction of the base 30, that is, the axial direction of the fixing belt 20, with a gap between adjacent ones of the resistive heat generators 31. As illustrated in FIG. 53, each of the resistive heat generators 31 may include a plurality of bent portions and may be electrically connected in parallel to the pair of electrodes 35 disposed at both lateral ends of the base 30 in the longitudinal direction thereof, respectively. In the heater 22 incorporating the plurality of resistive heat generators 31, the gap between the adjacent ones of the resistive heat generators 31 is 0.3 mm or greater preferably and is 0.4 mm or greater more preferably so as to attain insulation between the adjacent ones of the resistive heat generators 31. If the gap between the adjacent ones of the resistive heat generators 31 is excessively great, the heater 22 is susceptible to temperature decrease at the gap. Accordingly, in order to suppress uneven temperature of the heater 22 in the longitudinal direction thereof, the gap between the adjacent ones of the resistive heat generators 31 is 1 mm or smaller preferably and 0.7 mm or smaller more preferably.

Figure 54:
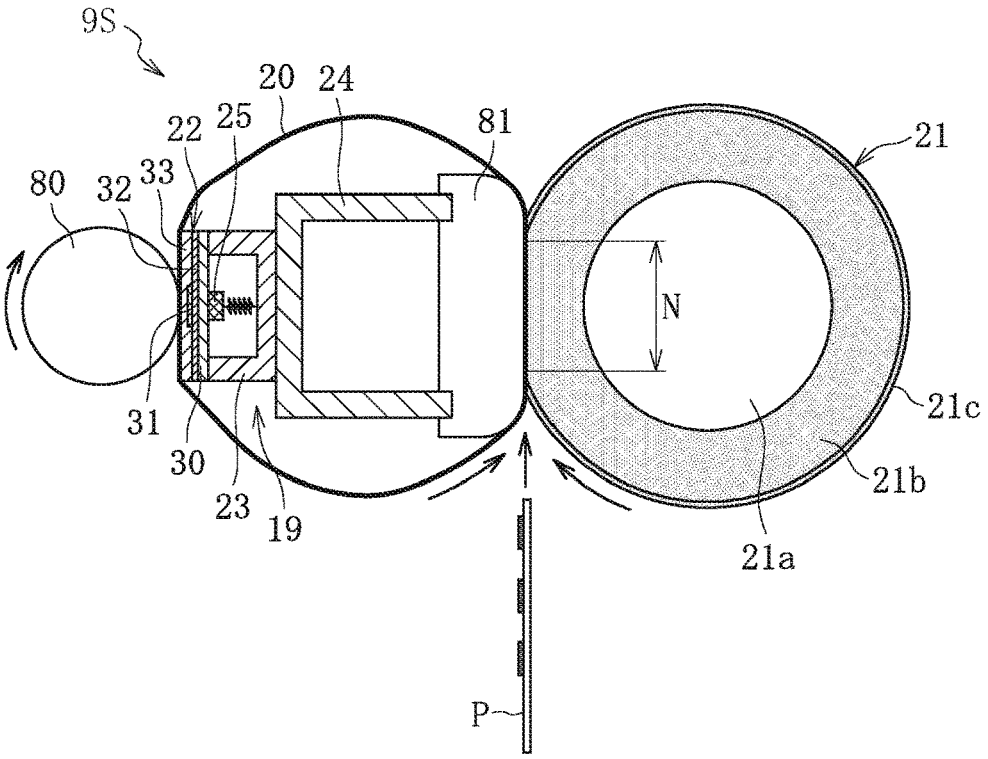
FIG. 54 is a schematic cross-sectional view of a fixing device as a first variation of the fixing device depicted in FIG. 2.
Figure 55:
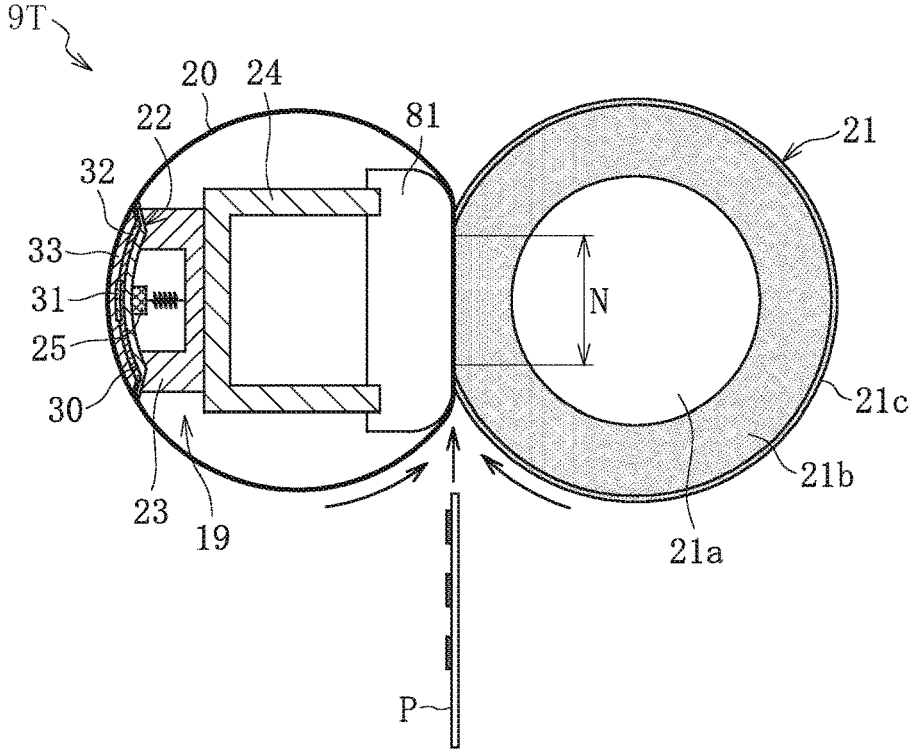
FIG. 55 is a schematic cross-sectional view of a fixing device as a second variation of the fixing device depicted in FIG. 2.
Figure 56:
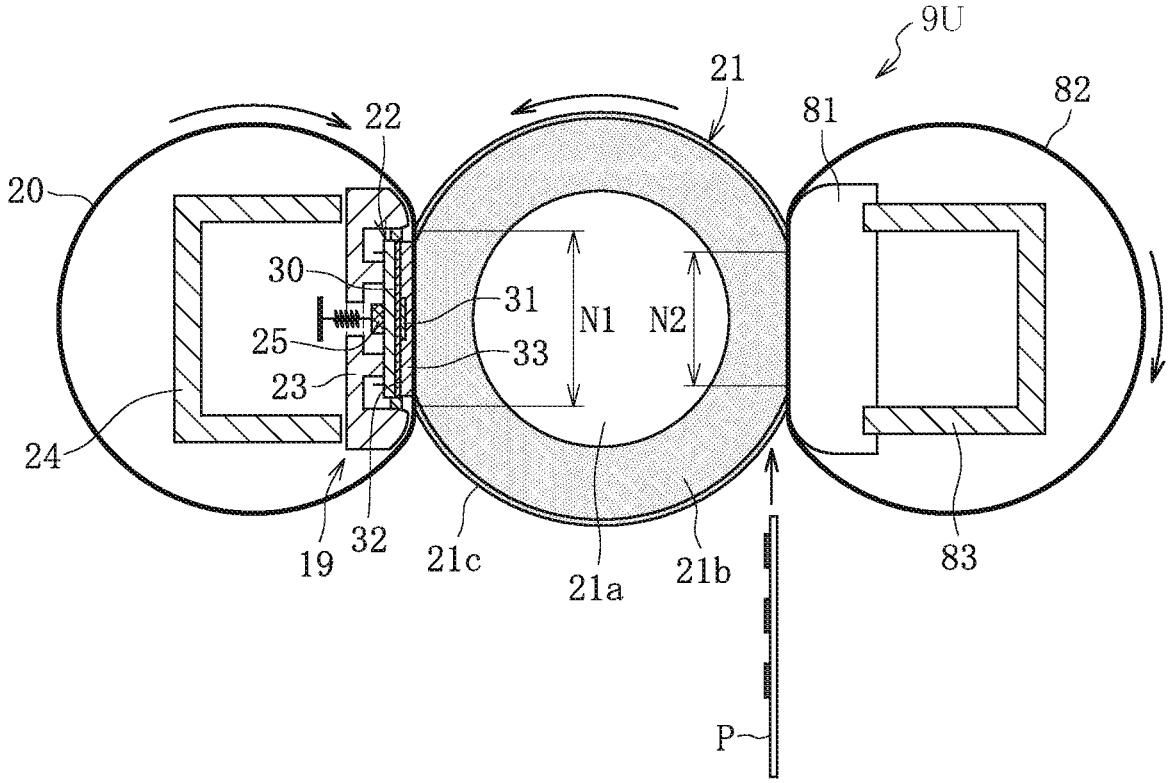
FIG. 56 is a schematic cross-sectional view of a fixing device as a third variation of the fixing device depicted in FIG. 2.

The embodiments of the present disclosure are applicable to fixing devices 9S, 9T, and 9U illustrated in FIGS. 54 to 56 other than the fixing device 9 illustrated in FIG. 2, for example. The following briefly describes a construction of each of the fixing devices 9S, 9T, and 9U depicted in FIGS. 54 to 56, respectively.

A description is provided of the construction of the fixing device 9S.

FIG. 54 is a schematic cross-sectional view of the fixing device 9S. As illustrated in FIG. 54, the fixing device 9S includes a pressing roller 80 disposed opposite the pressure roller 21 via the fixing belt 20. The pressing roller 80 and the heater 22 sandwich the fixing belt 20 such that the heater 22 heats the fixing belt 20. On the other hand, a nip forming pad 81 is disposed inside the loop formed by the fixing belt 20 and disposed opposite the pressure roller 21. The stay 24 supports the nip forming pad 81. The nip forming pad 81 and the pressure roller 21 sandwich the fixing belt 20 and define the fixing nip N.

A description is provided of the construction of the fixing device 9T.

FIG. 55 is a schematic cross-sectional view of the fixing device 9T. As illustrated in FIG. 55, the fixing device 9T does not include the pressing roller 80 depicted in FIG. 54. In order to attain a contact length for which the heater 22 contacts the fixing belt 20 in a circumferential direction thereof, the heater 22 is curved into an arc in cross-section that corresponds to a curvature of the fixing belt 20. Other construction of the fixing device 9T is equivalent to that of the fixing device 9S depicted in FIG. 54.

A description is provided of the construction of the fixing device 9U.

FIG. 56 is a schematic cross-sectional view of the fixing device 9U. As illustrated in FIG. 56, the fixing device 9U includes a pressure belt 82 in addition to the fixing belt 20. The pressure belt 82 and the pressure roller 21 form a fixing nip N2 serving as a secondary nip separately from a heating nip N1 serving as a primary nip formed between the fixing belt 20 and the pressure roller 21. For example, the nip forming pad 81 and a stay 83 are disposed opposite the fixing belt 20 via the pressure roller 21. The pressure belt 82 that is rotatable accommodates the nip forming pad 81 and the stay 83. As a sheet P bearing a toner image is conveyed through the fixing nip N2 formed between the pressure belt 82 and the pressure roller 21, the pressure belt 82 and the pressure roller 21 fix the toner image on the sheet P under heat and pressure. Other construction of the fixing device 9U is equivalent to that of the fixing device 9 depicted in FIG. 2.

According to the embodiments described above, a laminated heater (e.g., the heaters 22, 22S, 22T, 22U, 22V, 22W, 22X, 22Y, 22Z, 22D, 22J, and 22Q) includes a separation restrictor that restricts motion of the heater with respect to a holder (e.g., the heater holders 23, 23S, 23T, 23U, 23V, 23W, 23X, 23Y, 23Z, 23D, 23J, and 23Q) in the separating direction A. Accordingly, compared to a configuration in which the holder holds the heater with a separate member such as a heater clip, the number of parts is reduced. Consequently, manufacturing costs are reduced and the heater is attached to the holder readily. Additionally, according to the embodiments described above, the heater pivots about an engagement point where the heater engages the holder to attach the heater to the holder, facilitating and simplifying attachment of the heater to the holder. Accordingly, the heater is attached to the holder readily.

A description is provided of advantages of a heating device (e.g., the heating device 19).

As illustrated in FIGS. 2, 54, 55, and 56, the heating device includes a heater (e.g., the heaters 22, 22S, 22T, 22U, 22V, 22W, 22X, 22Y, 22Z, 22D, 22J, and 22Q) and a holder (e.g., the heater holders 23, 23S, 23T, 23U, 23V, 23W, 23X, 23Y, 23Z, 23D, 23J, and 23Q). The holder supports the heater. The heater is a laminated heater that heats an object to be heated (e.g., the fixing belt 20). As illustrated in FIG. 7, the heater includes a separation restrictor (e.g., the front faces 390, 410, 420, and 440) that engages the holder. The heater further includes a contact face (e.g., the contact face 39*a*) that contacts the object to be heated. As the separation restrictor engages the holder, the separation restrictor restricts motion of the heater in a separating direction (e.g., the separating direction A) which is perpendicular to the contact face and in which the heater separates from the holder.

According to the embodiments described above, the heater includes the separation restrictor that restricts motion of the heater with respect to the holder in the separating direction, reducing the number of parts of the heating device.

According to the embodiments described above, the fixing belt 20 serves as an endless belt. Alternatively, a fixing film, a fixing sleeve, or the like may be used as an endless belt. Further, the pressure roller 21 serves as an opposed rotator. Alternatively, a pressure belt or the like may be used as an opposed rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A heating device comprising:

a holder including an engaged portion; and a heater supported by the holder, the heater configured to heat an object, the heater including, a body including a contact face configured to contact the object to be heated, and a separation restrictor integrally formed with the contact face of the body in a one-piece design, the separation restrictor configured to engage the engaged portion of the holder to restrict separation of the heater from the holder in a separating direction in which the heater separates from the holder, the separating direction being perpendicular to the contact face.

2. The heating device according to claim 1, wherein the engaged portion of the holder includes an engaged face directed in a direction opposite the separating direction.

3. The heating device according to claim 1, wherein the engaged portion of the holder includes a projection projecting in a direction perpendicular to the separating direction.

4. The heating device according to claim 1, wherein the engaged portion of the holder includes a hole depressed in a direction perpendicular to the separating direction.

5. The heating device according to claim 1, wherein the heater further includes:

a primary bent portion bent from the body in a direction opposite the separating direction.

6. The heating device according to claim 5, wherein the separation restrictor is in the primary bent portion.

7. The heating device according to claim 6, wherein the separation restrictor includes a separating direction face directed in the separating direction.

8. The heating device according to claim 7, wherein the heater further includes a tab mounted on the primary bent portion, the tab including the separating direction face of the separation restrictor.

9. The heating device according to claim 7, wherein the heater further includes a hole in the primary bent portion and including the separating direction face of the separation restrictor.

10. The heating device according to claim 5, wherein the heater further includes a secondary bent portion bent from the primary bent portion in a direction perpendicular to the primary bent portion, the separation restrictor on the secondary bent portion.

11. The heating device according to claim 10, wherein the separation restrictor includes a separating direction face directed in the separating direction.

12. The heating device according to claim 1, wherein the heater further includes:

a tab defining an identical plane with the body and mounting the separation restrictor.

13. The heating device according to claim 1, wherein the separation restrictor is at one end of the heater in a longitudinal direction of the heater, and the heater further includes a positioner at another end of the heater in the longitudinal direction of the heater, the positioner configured to position the heater with respect to the holder in a direction parallel to the contact face.

14. The heating device according to claim 13, wherein the separation restrictor engages the holder as the heater pivots about an engaging point where the separation restrictor engages the holder.

15. The heating device according to claim 1, wherein the heater includes a laminated heater.

16. The heating device of claim 1, wherein the contact face and the separation restrictor have the one-piece design forming a single rigid structure.

17. The heating device of claim 1, wherein the object is a fixing belt.

18. The heating device of claim 1, wherein the heater includes a plurality of resistive heat generators.

19. The heating device of claim 1, wherein the engaged portion includes at least one projection projecting in the separating direction.

20. The heating device of claim 19, wherein the separation restrictor includes at least one tab projecting in a width direction of the body, the at least one tab configured to penetrate a gap in the tab to restrict separation of the heater from the holder in the separating direction.

21. A fixing device comprising:

an endless belt;

an opposed rotator configured to contact an outer circumferential surface of the endless belt to form a fixing nip between the endless belt and the opposed rotator; and a heating device including:

a holder including an engaged portion, and a heater supported by the holder, the heater configured to heat the endless belt the heater including, a body including a contact face configured to contact the endless belt, and a separation restrictor integrally formed with the contact face of the body in a one-piece design, the separation restrictor configured to engage the engaged portion of the holder to restrict separation of the heater from the holder in a separating direction in which the heater separates from the holder, the separating direction being perpendicular to the contact face.

22. The fixing device according to claim 21, wherein the heating device is inside a loop formed by the endless belt.

23. The fixing device according to claim 22, wherein the heater further includes:

a bent portion bent from the body in a direction opposite a direction directed to the endless belt.

24. The fixing device according to claim 22, wherein the heater further includes:

a tab defining an identical plane with the body and mounting the separation restrictor, the tab being outboard from the endless belt in an axial direction of the endless belt.

25. An image forming apparatus comprising:

an image forming device configured to form an image; and the fixing device of claim 21, the fixing device configured to fix the image on a recording medium.

26. The fixing device of claim 21, wherein the heater includes a plurality of resistive heat generators.

27. The heating device of claim 21, wherein the engaged portion includes at least one projection projecting in the separating direction.

28. The heating device of claim 27, wherein the separation restrictor includes at least one tab projecting in a width direction of the body, the at least one tab configured to penetrate a gap in the tab to restrict separation of the heater from the holder in the separating direction.

29. A heating device comprising:

a holder including an engaged portion; and a heater supported by the holder, the heater configured to heat an object, the heater including, a body including a contact face configured to contact the object to be heated, and a separation restrictor integrally formed with the contact face of the body in a one-piece design, the separation restrictor positioned relative to the body with a relative positional relationship therebetween being constant, and the separation restrictor configured to engage the engaged portion of the holder to restrict separation of the heater from the holder in a separating direction in which the heater separates from the holder, the separating direction being perpendicular to the contact face.

30. The heating device of claim 29, wherein the object is a fixing belt.

31. The heating device of claim 29, wherein the heater includes a plurality of resistive heat generators.

32. The heating device of claim 29, wherein the engaged portion includes at least one projection projecting in the separating direction.

33. The heating device of claim 32, wherein the separation restrictor includes at least one tab projecting in a width direction of the body, the at least one tab configured to penetrate a gap in the tab to restrict separation of the heater from the holder in the separating direction.

34. A heating device comprising:

a holder including an engaged portion; and a heater supported by the holder, the heater configured to heat an object, the heater including, a body including a contact face configured to contact the object to be heated, a separation restrictor integrally formed with the body, the separation restrictor configured to engage the engaged portion of the holder to restrict separation of the heater from the holder in a separating direction in which the heater separates from the holder, the separating direction being perpendicular to the contact face, and a primary bent portion bent from the body in a direction opposite the separating direction.

35. A heating device comprising:

a holder including an engaged portion; and a heater supported by the holder, the heater configured to heat an object, the heater including, a body including a contact face configured to contact the object to be heated, a separation restrictor integrally formed with the body at one end of the heater in a longitudinal direction of the heater, the separation restrictor configured to engage the engaged portion of the holder to restrict separation of the heater from the holder in a separating direction in which the heater separates from the holder, the separating direction being perpendicular to the contact face, and a positioner at another end of the heater in the longitudinal direction of the heater, the positioner configured to position the heater with respect to the holder in a direction parallel to the contact face.

* * * * *